US006343607B1

(12) United States Patent
Gueret

(10) Patent No.: US 6,343,607 B1
(45) Date of Patent: Feb. 5, 2002

(54) PRODUCT APPLICATOR, APPLICATION SYSTEM, AND METHOD OF APPLICATION FOR EYELASHES

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/624,004

(22) Filed: Jul. 21, 2000

(30) Foreign Application Priority Data

Jul. 21, 1999 (FR) ..... 99 09453

(51) Int. Cl.[7] ..... A45D 40/26
(52) U.S. Cl. ..... 132/218
(58) Field of Search ..... 132/218, 313, 132/317; 401/122, 126, 129; 15/206, 207, 207.2

(56) References Cited

U.S. PATENT DOCUMENTS

| | | | |
|---|---|---|---|
| 155,977 | A | 10/1874 | Rogers |
| 466,496 | A | 1/1892 | Heysinger |
| 791,690 | A | 6/1905 | Grell |
| 1,094,013 | A | 4/1914 | Peterson |
| 1,580,365 | A | 4/1926 | Bechtold |
| 1,670,161 | A | 5/1928 | Meyer |

(List continued on next page.)

FOREIGN PATENT DOCUMENTS

| | | |
|---|---|---|
| DE | 25 59 273 | 7/1977 |
| EP | 0 038 524 | 10/1981 |
| EP | 0 474 934 | 3/1992 |
| FR | 1 000 173 | 2/1952 |
| FR | 1 068 192 | 6/1954 |
| FR | 1 531 835 | 11/1968 |
| FR | 2 564 712 | 11/1985 |
| FR | 2 748 636 | 11/1997 |
| GB | 2 146 520 | 4/1985 |
| GB | 2 159 699 | 12/1985 |
| JP | 7-322915 | 12/1995 |
| JP | 9-108033 | 4/1997 |

*Primary Examiner*—Todd E. Manahan
(74) *Attorney, Agent, or Firm*—Finnegan, Henderson, Farabow, Garrett & Dunner, LLP

(57) ABSTRACT

An applicator, applicator system and method of using an applicator for applying a product to the eyelashes include an application element disposed on an end of a stem. The application element includes a base portion having a polygonal or non-polygonal cross section. A plurality of projection members are disposed on the base portion having a polygonal cross section such that at least two projection members extend away from the base portion substantially in continuation of a side of the base portion and in different directions from one another. At least one projection member is disposed on the base portion of non-polygonal cross section such that the projection member extends away from the base portion and an axis of the projection member is in a direction substantially at a tangent to the base portion where the projection member meets the base portion. Projection members extending from the base portion are oriented in the same direction of gyration with respect to a longitudinal axis of the base portion.

201 Claims, 13 Drawing Sheets

U.S. PATENT DOCUMENTS

| | | | | | |
|---|---|---|---|---|---|
| 1,780,206 | A | | 11/1930 | McKellar | |
| 1,829,228 | A | | 10/1931 | Lewis | |
| 1,892,749 | A | | 1/1933 | Philaja | |
| 1,963,389 | A | | 6/1934 | Vardeman | |
| 1,989,185 | A | | 1/1935 | Clein | |
| 2,007,245 | A | * | 7/1935 | Gimonet | 132/218 |
| 2,175,344 | A | | 10/1939 | Friedman | |
| 2,255,618 | A | | 9/1941 | Huppert | |
| 2,264,346 | A | | 12/1941 | Tupper | |
| 2,348,339 | A | | 5/1944 | Golden | |
| 2,569,246 | A | | 9/1951 | Marcellus | |
| 2,596,296 | A | | 5/1952 | Shields | |
| 2,626,618 | A | | 1/1953 | Collison | |
| 2,655,925 | A | | 10/1953 | Ulvad | |
| 3,033,213 | A | * | 5/1962 | Joss et al. | 132/218 |
| 3,312,583 | A | | 4/1967 | Rochlis | |
| 3,669,130 | A | | 6/1972 | Petroczky | |
| 3,763,870 | A | | 10/1973 | Montgomery et al. | |
| 3,862,639 | A | | 1/1975 | Schefer et al. | |
| 3,892,248 | A | | 7/1975 | Kingsford | |
| 3,921,650 | A | | 11/1975 | Montgomery | |
| 3,930,280 | A | | 1/1976 | Vasas | |
| 4,403,624 | A | | 9/1983 | Montgomery | |
| 4,422,986 | A | | 12/1983 | Cole | |
| 4,561,456 | A | | 12/1985 | Gueret | |
| 4,565,205 | A | | 1/1986 | Taylor | |
| 4,635,659 | A | | 1/1987 | Spatz | |
| 4,660,582 | A | | 4/1987 | Taylor | |
| 4,712,936 | A | | 12/1987 | Kessler | |
| 4,744,377 | A | | 5/1988 | Dolan, Jr. | |
| 4,804,004 | A | | 2/1989 | Taylor | |
| 5,007,442 | A | | 4/1991 | Hirzel | |
| 5,046,213 | A | | 9/1991 | Curtis et al. | |
| 5,086,793 | A | | 2/1992 | Kingsford | |
| 5,137,387 | A | | 8/1992 | Byrd et al. | |
| 5,918,994 | A | | 7/1999 | Gueret | |
| 5,951,185 | A | | 9/1999 | Kingsford et al. | |
| 6,053,179 | A | | 4/2000 | Lhuisset | |

* cited by examiner

PRODUCT APPLICATOR, APPLICATION SYSTEM, AND METHOD OF APPLICATION FOR EYELASHES

The present invention pertains to an applicator for applying a product. In particular, the present invention is directed toward an applicator for the application of a product, such as a cosmetic product for example, to keratinous fibers such as the eyelashes or eyebrows. The invention also relates to an applicator system including the applicator and a container for containing the product to be applied.

The invention also relates to a device for combing the eyelashes or eyebrows including at least one row of elements, such as bristles or teeth, on a base of an application element. There is a need to improve the quality of the makeup effect achieved using conventional applicators of this general type.

For example, there is a need to provide an applicator capable of loading the eyelashes with a relatively substantial amount of product and of gripping the eyelashes in order to smooth out the product deposited on the surface of the eyelashes.

There also exists a need to facilitate the procedure of applying the product by allowing the user to apply makeup satisfactorily to eyelashes or eyebrows by using a single applicator without having to resort to an additional comb or the like to smooth out the eyelashes or eyebrows after having applied the product.

Moreover, it is desired to provide an applicator for combing the eyelashes which is easy to manufacture and has repeatable geometry.

It also is desirable to provide an applicator which allows the eyelashes to be sufficiently curled and lengthened after product has been applied.

In addition, if the product being applied is an eyelash product containing fibers, it is desirable to provide an applicator including an application element capable of aligning the fibers such that they are oriented substantially parallel to the eyelashes when the product is applied.

The applicator according to one aspect of the invention includes an application element having a base portion of polygonal cross-section having a plurality of sides and a plurality of projection members disposed on the base portion. At least two of the projection members extend away from the polygonal base portion substantially in continuation of different sides of the base portion and in different directions from one another. In an alternative aspect of the invention, the application element includes a base portion having a non-polygonal cross-section and at least one projection member disposed on the base portion. The at least one projection members extends away from the base portion such that an axis of the projection member is in a direction substantially at a tangent to the base portion where the projection member meets the base portion.

As used throughout the specification and claims, the axis of a projection member or projection element refers to an axis of the element extending substantially in a plane perpendicular to the direction of the length of the base portion. In other words, the axis of the projection member or projection element is the axis extending from the portion of the projection member or projection element that meets the base portion to a free end of the projection member or projection element.

As a preference, the applicators described above preferably include at least two projection members oriented in the same direction of gyration about the longitudinal axis of the base. Moreover, at least two projection members preferably are adjacent to one another, and also may be either substantially parallel to one another or not substantially parallel to one another.

In yet another aspect of the invention, an applicator is provided that includes an application element including a base portion having a polygonal cross-section and a plurality of sides. A plurality of projection members are disposed on the base portion, at least two of which extend away from the base portion substantially in continuation of different sides of the base portion. The at least two projection members also are oriented in the same direction of gyration about a longitudinal axis of the base portion.

Arranging projection members on the base portion in the manners described according to the invention may facilitate contact between the eyelashes and the base portion, which is typically more difficult using conventional applicators of the twisted wire type. In accordance with the present invention, however, when the applicator is used to apply the product, the eyelashes may become laden with product upon contact with the base portion. The base portion preferably actively participates in applying the product to the eyelashes by virtue of the arrangement of the projection members in the present invention.

The applicators according to certain aspects of the invention preferably include a stem and the application element preferably is on an end of the stem.

In certain aspects of the invention, a projection member may include a row of consecutive projection elements which may be arranged in a variety of manners. Preferably, the applicator of the present invention permits these projection elements to be produced with a close spacing between consecutive elements in each row.

Within the meaning of the invention, projection elements or projection members can include, for example, bristles or teeth. The teeth or bristles may be made separate from the base portion and attached to the base portion to form the application element. Alternatively, the teeth or bristles may be formed integrally with the base portion, such as, for example, by molding.

As a preference, the base has a substantially uniform cross section over at least a portion of its length and all of the projections elements of a row located on this portion, preferably of each row, extend practically in the continuation of the corresponding side of the base.

The base may have a variable cross section with a profile practically in the shape of a polygon, regular or otherwise but preferably regular, for example in the shape of a triangle, square, pentagon or hexagon, it being possible for the faces corresponding to the sides of the base to be planar, or slightly concave or convex.

The polygonal base portion may have a cross section chosen from triangular, square, pentagonal, heaxagonal, or octagonal, for example. The non-polygonal base portion may have a cross-section chosen from elliptical and circular, for example.

The applicator according to one aspect of the present invention may be a device capable of combing the eyelashes or eyebrows and includes at least one row of consecutive projection elements including consecutive projection elements alternately disposed on opposite sides of a geometric separation surface.

As mentioned above, the projection elements could be teeth. By altering the geometry of the teeth and their spacing, it is possible to form greater or lesser cavities between the teeth, which cavities can become laden with product at the time of application.

It is thus possible to produce a row of projection elements capable of becoming laden with a substantial amount of product, without negatively affecting the ability of the row of elments to grip the lashes.

Portions of at least two consecutive projection elements in the row of consecutive projection elements may be substantially aligned with one another. The expression "substantially aligned" as used throughout the specification and claims should be understood to mean that one part of each of the substantially aligned portions of the consecutive projection elements is disposed on a first side of a line passing through the portions of the consecutive projection elements, and another part each of the aligned portions of the consecutive projection elements is disposed on a second side of the line opposite to the first side, wherein the line is substantially parallel to a longitudinal axis of the row of consecutive projection elements. An example of an embodiment with such "substantially aligned" portions includes consecutive projection elements disposed such that a straight line passes through the centers of each of the root portions of the consecutive projection elements, especially when the elements are in the form of teeth. However, other embodiments also are contemplated by the present invention.

Moreover, at least two consecutive projection elements may have portions substantially contiguous with one another. The expression "substantially contiguous portions" as used throughout the specification and claims should be understood as meaning that an eyelash inserted between the consecutive teeth in a plane substantially perpendicular to a longitudinal axis of the application element is prevented from moving freely between the portions due to the proximity of the portions to one another. In other words, when the application element is placed in contact with the eyelashes such that it extends substantially transversely to the eyelashes, an eyelash entering between consecutive teeth having portions substantially contiguous with one another will be prevented from moving freely between the portions and gripped due to the proximity of the portions to one another. The gripping of the substantially contiguous portions could occur at any position along the length of the consecutive teeth. In addition, the substantially contiguous portions can be close enough to one another so that passage of an eyelash between parts of the consecutive teeth is prevented. Although "substantially contiguous portions" encompasses portions contacting or overlapping with one another, "substantially contiguous portions" are not required to contact one another as long as an eyelash is prevented from moving freely between the portions. The exact dimensions for the substantially contiguous spacing could be selected based on a number of factors, such as the average diameter of eyelashes and the particular type of product being applied.

The substantially contiguous portions may provide a gripping of an eyelash. This gripping allows a product to be spread in a substantially uniform manner along the substantially the entire length of an eyelash. When the applicator is used to apply mascara, such substantially uniform application along substantially the entire length of the eyelashes makes the eyelashes appear to be lengthened. The gripping of the eyelashes by the substantially contiguous portions also allows the eyelashes to be rearranged by moving the applicator. For example, when the eyelashes are gripped, displacement, such as rotation for example, of the applicator could provide corresponding curling of the gripped lashes.

The expression "overlapping portions" as used herein should be understood as meaning portions covering one another when the application element is observed from the side or from an end, or which, at a minimum, cover one another only via an edge or point of contact. Thus, the substantially contiguous portions may preferably be overlapping faces extending either perpendicular to the longitudinal axis of the base portion (or of the row of elements) or substantially parallel to the longitudinal axis of the base portion (or of the row of elements).

At least one interstice, preferably in the form of a V-shaped notch, may be defined between the at least two consecutive projection elements having substantially contiguous portions.

When the base portion is viewed along its longitudinal axis, i.e., from an end of the base portion, at least two consecutive elements may have upper portions either diverging away from one another, converging toward one another, crossing one another, or extending substantially parallel to one another. At least two consecutive projection elements also may have upper portions directed toward opposite ends of the base portion.

The geometric separation surface preferably passes through the centers of roots of the substantially aligned projection elements. The roots preferably are parallel and their height may be greater than or equal to approximately 0.2 mm.

Consecutive projection elements may be produced with a close spacing at their roots so that the lashes can be gripped effectively between two consecutive teeth, while at the same time having a wider spacing between their upper portions, especially their free ends. Preferably, this spacing will encourage the lashes to engage between the projection elements and be gripped and also will contain some of the product on the application element.

The geometric separation surface on opposite sides of which the consecutive projection elements may be alternately disposed may be a plane. The geometric separation surface preferably is a parting line for the molding of the application element. The geometric separation surface may also be a cylindrical surface, the directrix of which is a curve or a broken line. The geometric separation surface may be a non-planar surface, for example a twisted or helical surface. In certain embodiments, the geometric separation surface is a plane passing through a plane of alignment of substantially aligned portions of at least two consecutive teeth.

In an aspect of the invention, the application element includes projection elements in the form of teeth having roots. The roots may have a larger depth than width.

Projection elements also may be deeper than the gap separating two adjacent projection elements disposed on the same side of said geometric separation surface, wherein the depth is measured in a direction substantially perpendicular to the longitudinal axis of the base portion and the gap is measured in a direction substantially parallel to the longitudinal axis of the base portion.

The depth of the projection elements, and of the roots of the teeth provide a relatively large mechanical strength, allowing the application element to withstand forces exerted by the eyelashes.

The applicator according to aspects of the invention may also be capable of applying a product likely to dry fairly quickly.

The ratio b/e preferably is greater than or equal to approximately 1.2, or even greater than or equal to approximately 1.4, where b is the depth of the root of a tooth and e is its width.

The ratio b/c preferably is greater than or equal to approximately 1.2, or even greater than or equal to approximately 1.4, where b is the depth of the root of a tooth and c is the gap separating two successive teeth offset to one and the same side of said geometric separation surface.

The teeth may have a depth which varies according to the axial position along the axis of the base. The teeth may thus have a depth which increases, decreases, increases then decreases or vice versa, from the front backward.

The application element may include projection elements with at least one face facing an end of the base portion being disposed at an angle to a longitudinal axis of the base portion. The angle may be perpendicular to, acute to, or obtuse to the longitudinal axis. Preferably, the roots of teeth have front and/or rear faces (i.e., faces facing the distal and proximal ends of the base portion respectively) which are perpendicular to the axis of the longitudinal axis base or form an acute or obtuse angle therewith.

The row of projection elements preferably includes a first series of projection elements having faces facing one of the ends of the base portion and being inclined in one direction with respect to the longitudinal axis of the row, and a second series of projection elements, alternating with the first series, having faces facing one of the ends of the base portion inclined in a different direction than the teeth of the first series with respect to the longitudinal axis of the row.

For example, at least one row of elements comprising a first series of teeth may have front and/or rear faces inclined with respect to the axis of the base, and a second series of teeth may have front and/or rear faces inclined in a different direction than the teeth of the first series with respect to the axis of the base. The teeth of the first series and those of the second series being arranged alternately at least partially opposite sides of a geometric separation surface.

The application element of the present invention may include at least one projection element having one of a convex and a concave face facing toward an end of the application element. Preferably, at least two consecutive projection elements have a convex and a concave face facing an end of the application element. One of the two projection elements may have one of a convex and a concave face facing an end of the application element while the other of the two consecutive projection elements has a planar face facing the end of the application element.

The row of elements may include a first series of teeth located on one side of a geometric separation surface and a second series of teeth located on the other side of this geometric separation surface, alternating with the teeth of the first series, the teeth of the first series having a convex or concave front (or rear) face facing forward (or backward), and the teeth of the second series having a concave or convex front (or rear) face facing forward (or backward).

The row of elements also may include a first series of teeth located on one side of a geometric separation surface and a second series of teeth located on the other side of this geometric separation surface, the teeth of the first series being arranged in alternation with the teeth of the second series, the teeth of the first series having a concave or convex front (or rear) face facing forward (or backward), and the teeth of the second series having a planar rear (or front) face.

According to yet another aspect of the invention, preferably three consecutive projection elements in a row define a volume configured to contain the product to be applied. Preferably a ratio between the gap separating two adjacent projection elements on the same side of a geometric separation surface and the width of a tooth disposed on the opposite side of the geometric separation surface and intermediate the two adjacent teeth ranges from approximately 0.2 to 2.0. Preferably, the gap and width are measured at approximately a mid-portion of the height of the projection elements.

According to another aspect of the invention, the projection member and an adjacent side of the base portion, other than the side from which the projection member extends substantially in continuation, define an open volume configured to contain product to be applied.

The projection members and the base portion preferably are molded together as a single piece using plastic.

The base portion preferably is substantially elongate and the projection members preferably extend along the length of the base portion. The row of consecutive projection elements also preferably extends along the length of the base portion. The base portion also preferably has a uniform cross-section over at least part of its length. The base portion may have a cross-section chosen from either a regular polygon or an irregular polygon. One or more sides of the base portion may be non-planar, such as concave or convex, for example.

The projection members may have a free edge that is serrated, the serrations being configured to grip the eyelashes between them.

The application element may include two parts made with a film hinge and joined together.

The height of the projection members or projection elements may vary, preferably along a length of the base portion.

The height of the projection members or projection elements preferably ranges from approximately 0.5 mm to approximately 15 mm, and more preferably between 7 mm to 13 mm.

The applicator stem on which the application element is disposed preferably is produced by molding plastic. The application element and stem may be molded together as a single piece. Alternatively, the application element may be removably connected to the distal end portion of the stem. The longitudinal axis of the application element may either extend substantially parallel to the longitudinal axis of the stem or may extend at an angle, even perpendicular to, the longitudinal axis of the stem.

The application element may have a tapered distal tip to facilitate its insertion into a container containing the product to be applied. This tip may or may not have projection elements disposed thereon.

The application element may be produced by molding plastic as a single piece with the applicator stem and with a sealing member intended to seal the container closed when not in use, this sealing member preferably having a surface shaped to fit in sealed manner into the neck of the container. Alternatively, a cap, disposed on an end of the stem opposite to the application element and configured to close an opening in the container may include the sealing member. Thus, the cap may sealably close the container.

It is preferable for the base portion to be made of an elastomeric material and for the stem to be made of a rigid or semirigid plastic material, the base portion being overmolded on the stem or attached thereto.

Making the base portion and the projection elements out of an elastomeric material facilitates passage of the applicator through the wiper. Moreover, the comfort in using the applicator may also be improved.

As an alternative, the stem may be made of a plastic more flexible than the plastic used to make the application element. It is thus possible, especially if necessary for manufacturing reasons, to use a relatively inflexible material to make the application element and to compensate for the inflexibility of the application element at the time of application with the flexibility of the stem.

The application element according to yet another aspect of the invention may include a polygonal or non-polygonal base portion having solid sides. Preferably, the base portion may be an integral, unitary, single piece construction. Even more preferably, the base portion may be produced by molding. Such a solid, single piece structure may prevent eyelashes from passing through the base portion and reaching the longitudinal axis of the base portion. This embodiment is in contrast to some conventional mascara applicators having bristles extending radially from an axially-arranged, twisted wire core, for example.

In another aspect of the invention, the application element could lack a twisted wire. Moreover, the projection members may extend from the application element at origination locations spaced from a longitudinal axis of the base portion.

The inventive applicator described above may be used in conjunction with a container containing the product. Preferably, the container has a wiper configured to remove excess product from the projection members (i.e., including teeth) of the application element when the applicator is removed from the container. This wiper is preferably deformable, and may include, for example, a block of foam or an elastomeric lip. A deformable wiper allows the wiper to conform to the shape of the application element as it is extracted from the container, therefore improving the wiping effect.

Other aspects of the invention include a method for applying a product to eyelashes comprising providing either the systems or applicators described above, loading a product on at least a part of the application element of the applicator, and placing at least some of a part of the application element in contact with the eyelashes such that the product coats the eyelashes. The loading may include inserting the applicator into a container containing the product and removing the applicator from the container and wiping excess product from the projection members. Alternatively, the loading may include dispensing the product from the container onto the application element or contacting the application element with a solid cake of product. Preferably, the latter type of loading also includes moistening the solid cake of product. The moistening may include moistening the application element. The method also includes gripping the eyelashes with at least part of the application element.

Where the mascara product includes fibers, the method further includes orienting the fibers with the application element such that the fibers are substantially parallel to the eyelashes as the product is applied. This alignment of the fibers preferably occurs as a result of a bottleneck type of effect produced by the serrations of projection members or spacing between consecutive projection elements in a row of the application element.

The method further includes contacting the eyelashes with a product loaded on the base portion of the application element and then with the projection member.

Another aspect of the method according to the invention includes connecting a portion of the application element to the stem. Prior to connecting the application element, one of a plurality of application elements may be selected to connect to the stem.

Preferably, the applicators, systems and methods of the present invention are used to apply a cosmetic product, for example, mascara, to the eyelashes, however other products also could be used and be applied to other surfaces.

Aside from the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is an axial cross-sectional view of an applicator inserted into a container containing a product to be applied according to an aspect of the invention;

Figure 1:
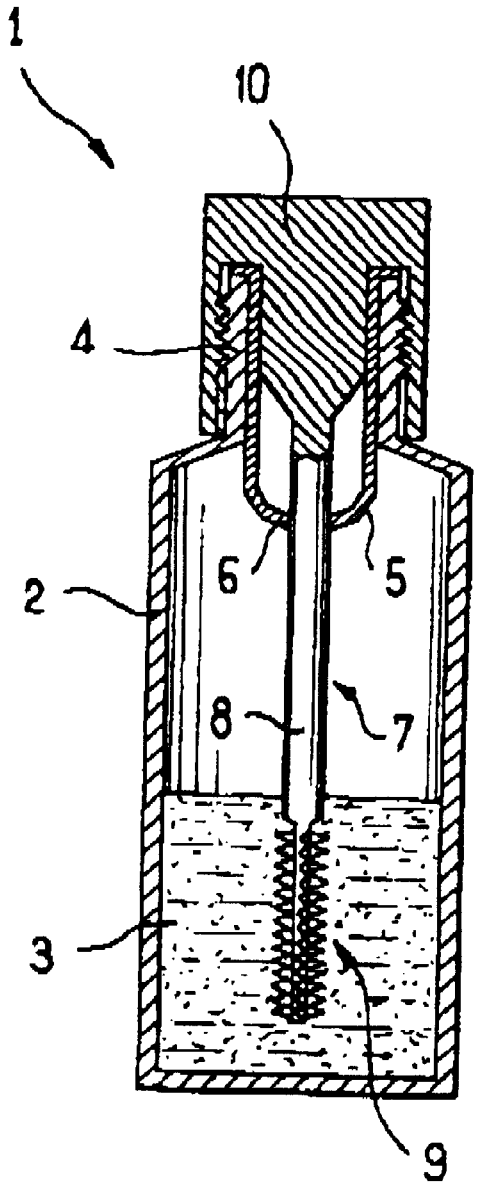
FIG. 1A is a partial cross-sectional view of an applicator system wherein the wiper is in the form of block of open-cell foam according to an aspect of the invention.
Figure 1A:
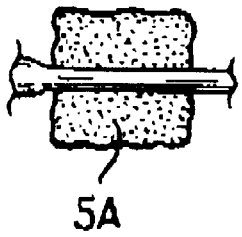

The applicator system 1 shown in FIG. 1 includes a container 2 containing a product 3, preferably a cosmetic or treatment product for the eyelashes or eyebrows, for example mascara. The container 2 has a threaded neck 4 defining an opening. The opening is fitted internally with a wiper 5 including a part inserted in the neck 4 having an elastically deformable annular lip defining a circular wiping orifice 6 at its lower end. Preferably, the lip is made of an elastomeric material and may or may not be flocked. Alternatively, the deformable wiper may include a block of open cell foam 5A, as shown in FIG. 1A. In either case, the wiper preferably is deformable so that it conforms to the shape of the application element.

Figure 2:
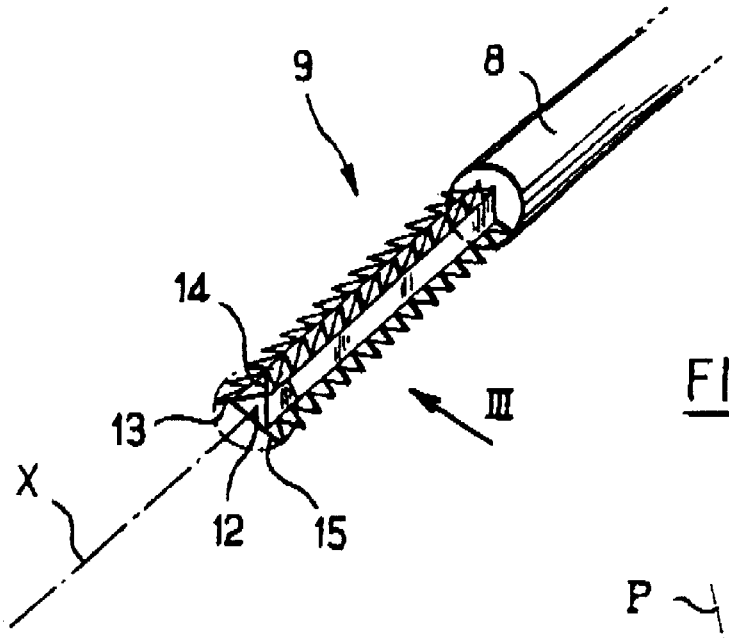
FIG. 2 is a detailed view of the applicator of FIG. 1.
Figure 3:
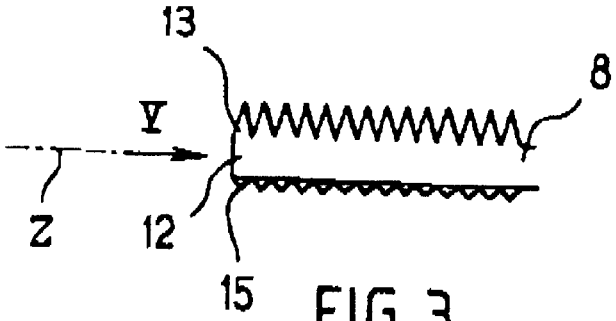
FIG. 3 is a partial side view of the application element looking in the direction of arrow III of FIG. 2.

The system 1 includes an applicator 7 including a stem 8 having an axis X (FIG. 2). At one end of the stem 8 an application element 9 is disposed and at the other end of the stem 8 is a handling member 10 for grasping. The handling member 10 may be in the form of a cap, as shown, configured to sealably close the opening of the container 2 and designed to be screwed on to the neck 4.

The stem 8 may be made of a rigid or semirigid material, preferably by molding a plastic.

As shown, the stem 8 is straight but could, as an alternative, also be curved.

The wiping orifice 6 has a diameter such that excess product is removed from the stem 8 and the application element 9 as the applicator is extracted from the container 2.

FIGS. 2–5 show the application element 9 on a larger scale. The application element includes a base portion 12 of substantially elongate shape and a triangular cross section defining three sides 17, 18 and 19. The longitudinal direction Z of the base portion coincides, in the example described, with the axis X of the stem 8. The base portion need not have a triangular cross-section but may have other regular and non-regular polygonal cross-sections, or a non-polygonal cross-section, as will be explained.

The base portion also could be produced in the continuation of the stem 8 with an angle formed between the longitudinal axis of the base portion and that of the stem, without departing from the scope of the present invention.

The base portion 12 also is substantially straight in the example described. It could, however, like the stem, be curved or extend in a broken line.

In the example described, the base portion 12 includes three projection members in the form of three rows of consecutive projection elements 13, 14 and 15. The projection elements in each row are consecutively placed in a direction substantially parallel to the longitudinal axis X of the base 12.

Figure 4:
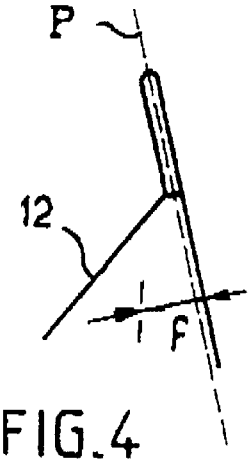
FIG. 4 is a partial cross-sectional detailed view of the base portion of the application element according to an aspect of the present invention.
Figure 5:
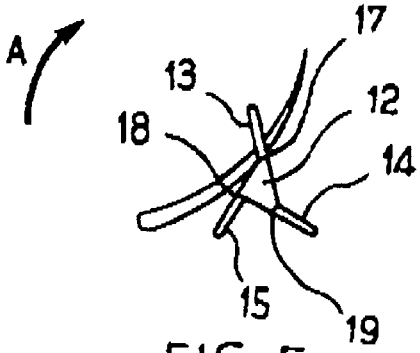
FIG. 5 is a front end view in the direction of arrow V of FIG. 3, illustrating use of the applicator to apply a product to eyelashes according to an aspect of the present invention.
Figure 6:
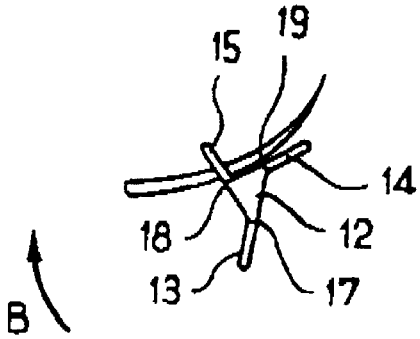
FIG. 6 is view similar to FIG. 5 showing an alternative form of the application element used to apply of product to the eyelashes.
Figure 7:
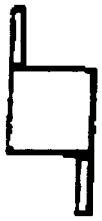
FIG. 7 is a cross-sectional view of an application element including a square base portion according to an aspect of the invention.
Figure 8:
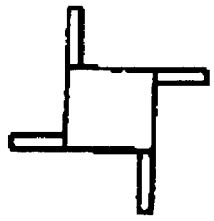
FIG. 8 is a cross-sectional view of an application element including a square base portion according to another aspect of the invention.

As can best be seen in FIGS. 4–6, the projection elements of each row extend away from the base portion 12 substantially in the continuation of a side of the base portion 12.

In the example described, the projection elements extend parallel to the plane of the side of the base portion from which they extend substantially in continuation, but it would not be departing from the scope of the present invention if the elements were to be inclined slightly with respect to this plane.

Figure 45:
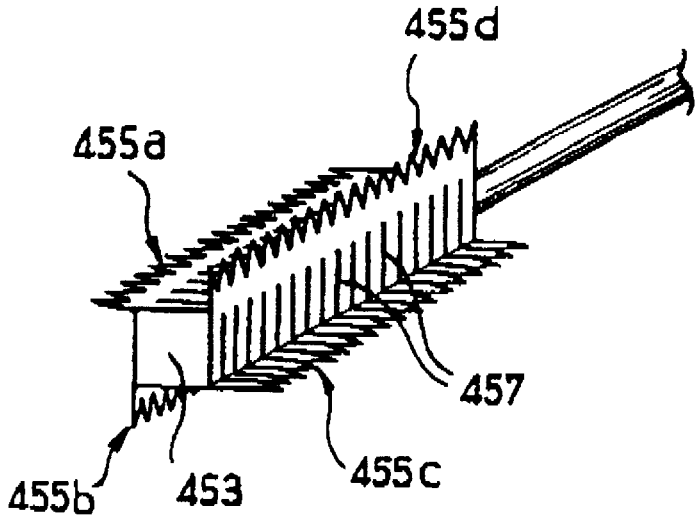
FIG. 45 is a partial perspective view of an applicator having an application element with a base portion of substantially uniform square cross-section and serrated projection members according to an aspect of the invention.
Figure 46:
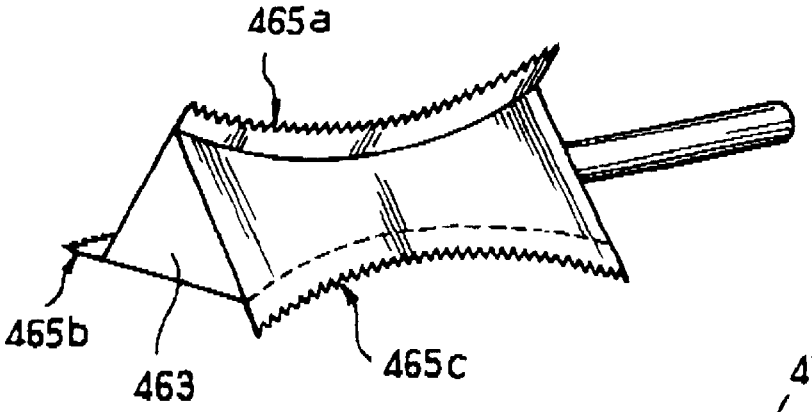
FIG. 46 is a partial perspective view of an applicator having an application element with a base portion of triangular cross-section and concave sides and serrated projection members according to an aspect of the invention.
Figure 47:
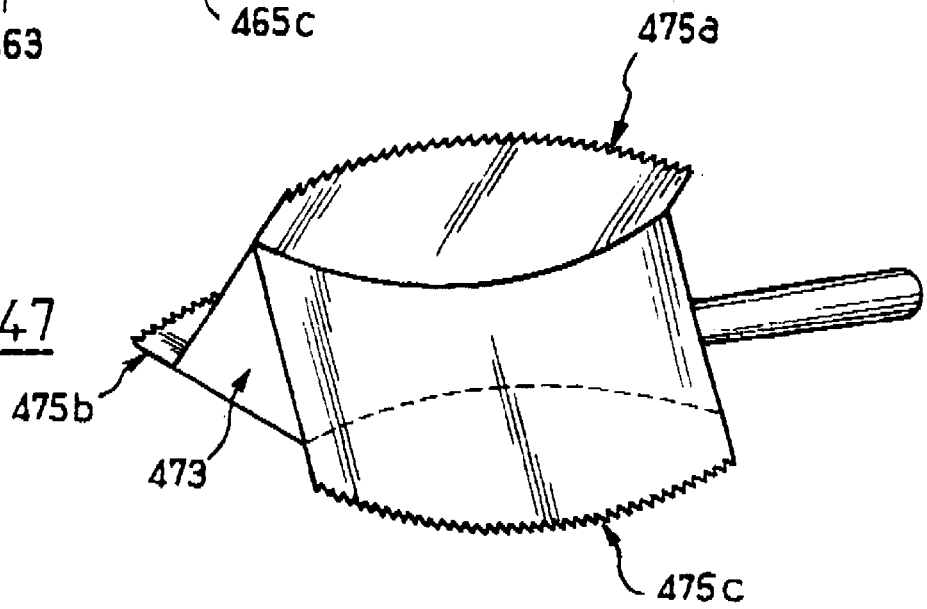
FIG. 47 is a partial perspective view of an applicator having an application element with a base portion of substantially triangular cross section and concave sides and serrated projection members varying in height along a length of the base portion according to an aspect of the invention.

Similarly, each side of the base portion may be non-planar, for example slightly concave or convex, as shown in FIGS. 46 and 47. Moreover, the base portion may include reliefs or a surface texture designed to hold the product, as will be discussed with reference to FIG. 45.

In the example described, the projection elements of each row are inclined, at least at their root, at a non-zero angle with respect to a radial plane starting from the center of the base and passing through the roots of the projection elements in each row.

In addition, as illustrated in FIG. 4, each row of elements may extend substantially in a plane P passing a non-zero distance f from the center of the base portion 12.

The projection elements of the three rows 13, 14, and 15 are oriented in the same direction of gyration about the longitudinal axis of the base portion 12, for example in the counterclockwise direction when the application element is viewed from an end of the base portion. That is, they are oriented in the opposite direction to the arrow A in FIG. 5.

As an alternative, as shown in FIG. 6, the projection elements of the three rows 13, 14, and 15 are all oriented in the opposite direction of gyration, as compared to the direction of gyration shown in FIG. 5, namely in the direction of arrow B in FIG. 6.

As a non-limiting example, elements extending in the same "direction of gyration" as used herein may be understood through the image of a certain kinds of water wheels and the manner in which paddles are disposed thereon relative to one another. When the water wheel is rotated a predetermined amount so that a first paddle is disposed at substantially the same circumferential position previously occupied by a second paddle, the first paddle faces in substantially the same direction as the second paddle faced at that position.

In FIGS. 2–6, the row 13 is in the continuation of the side 17 of the base 12, the row 15 extends in the continuation of the side 18, and the row 14 extends in the continuation of the side 19. When the applicator is withdrawn from the container 2, the application element 9 is laden with product, the latter being present both on the sides of the base portion 12 and between the projection elements in each row. To apply the product, one face or side of the base portion, for example the side 18 in the example of FIG. 5, is brought into contact with the eyelashes.

Because the elements of the row 15 are substantially in the continuation of the side 18 it may be possible to achieve relatively extended contact between the eyelashes and the base portion 12 at the time of application. This in turn may make it possible to load the lashes with a fairly substantial amount of product. Moreover, the lashes can tangentially contact the side 18 of the base portion and the row 15 of projection elements located substantially in its continuation, as the applicator is rotated and brought across the eyelashes.

Overall, using an applicator according to the invention, it may be possible to create a relatively large area of contact between the application element and the lashes.

Also, application of the product can occur without the need for the applicator to be frequently reinserted into the container 2. This is because the product present on the other sides 19 and 17 of the base portion 12 of the application element may still be used even after having turned the applicator through one third of a revolution or two thirds of a revolution in the direction of arrow A.

As the eyelashes come into contact with the application element, they can gradually engage, as shown in FIG. 5, between the projection elements in the row 13. The projection elements preferably are arranged such that the eyelashes may be gripped, separated, smoothed, and curled.

It will be understood that different make-up effects can be obtained according to the way in which the application element is positioned with respect to the eyelashes and according to the orientation of the projection elements about the base portion, the direction of rotation of the application element, the overall movement of the applicator during application, and the manner in which projection elements in the same row are disposed and configured.

The invention is not restricted to a base portion having a cross section of triangular shape and, in the examples illustrated in FIGS. 7–10, and 50 the base portion has cross sections of square, rectangular, pentagonal, hexagonal, and octagonal shapes respectively. The sides of the base portion may be planar or non-planar, such as convex or concave for example. The rows of projection elements are disposed substantially in the continuation of the sides of the base portion.

Figure 11:
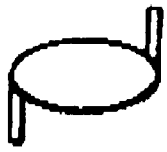
FIG. 11 is a cross-sectional view of an application element including an elliptical base portion according to an aspect of the invention.
Figure 9:
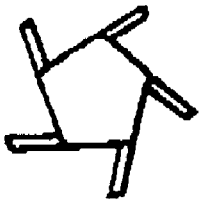
FIG. 9 is a cross-sectional view of an application element including a pentagonal base portion according to an aspect of the invention.
Figure 10:
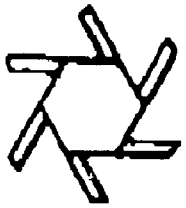
FIG. 10 is a cross-sectional view of an application element including a hexagonal base portion according to an aspect of the invention.

The base portion may also have a non-polygonal cross section, for example a cross section of elliptical shape, as illustrated in FIG. 11.

FIG. 11 shows two rows of projection elements disposed on the base portion such that they extend away from the base portion. An axis of the projection elements is in a direction substantially at a tangent to the base portion where the projection elements each meet the base portion. The rows of projection elements in FIG. 11 are disposed on the base portion substantially diametrically opposite from one another.

FIGS. 12–18 illustrate various configurations of the projection elements which can be disposed on the application element.

Figure 12:
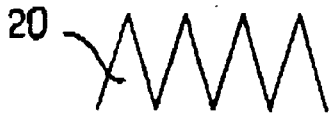
FIG. 12 is an example of a row of projection elements of an application element according an aspect of the present invention.

For example, one or a number of rows of projection elements of the application element may include a series of teeth 20 with a triangular saw-tooth profile, as illustrated in FIG. 12.

Figure 18:
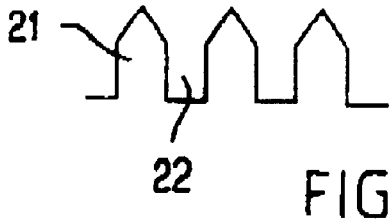
FIG. 18 is an example of a row of projection elements of an application element according another aspect of the present invention.
Figure 13:
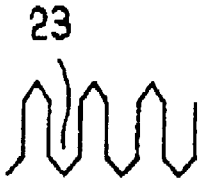
FIG. 13 is an example of a row of projection elements of an application element according an aspect of the present invention.

The application element may include teeth 21 forming flat-bottomed grooves 22 between them, as illustrated in FIG. 18, or notched-bottom grooves between them, as illustrated in FIG. 13.

Figure 14:
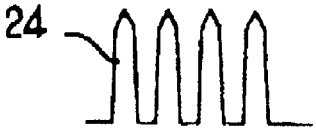
FIG. 14 is an example of a row of projection elements of an application element according an aspect of the present invention.
Figure 15:
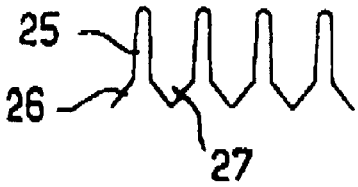
FIG. 15 is an example of a row of projection elements of an application element according another aspect of the present invention.

The application element may alternatively include teeth or bristles 24 in the shape of an obelisk, as illustrated in FIG. 14, or teeth or bristles 25 with a slightly conical upper part with a rounded tip and a widened frustoconical root 26, as illustrated in FIG. 15.

Figure 16:
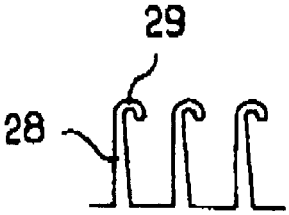
FIG. 16 is an example of a row of projection elements of an application element according yet another aspect of the present invention.
Figure 17:
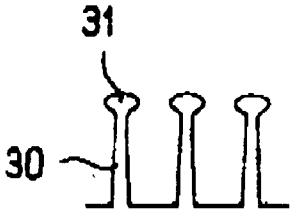
FIG. 17 is an example of a row of projection elements of an application element according an aspect of the present invention.

The application element may include projection elements 38 with heads 29 which are bent over, for example in a hook-like configuration, as illustrated in FIG. 16, or may include projection elements 30 with widened heads 31, as illustrated in FIG. 17.

Figure 20:
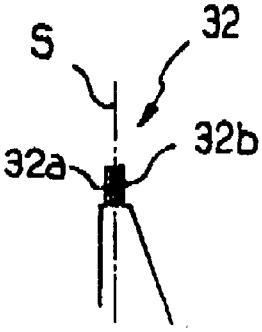
FIG. 20 is a front end view of the base portion of an application element the row of consecutive projection elements of FIG. 19 alternately disposed on opposite sides of the geometric separation surface S.
Figure 19:
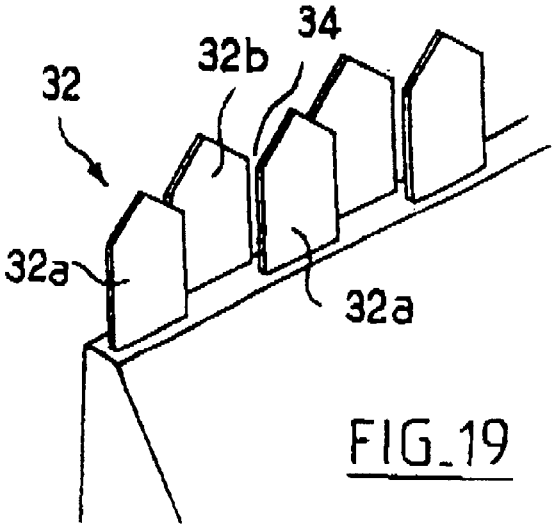
FIG. 19 is a partial perspective view of a base portion of an application element and row of consecutive projection elements alternately disposed on opposite sides of a geometric separation surface according to an aspect of the invention.

Consecutive projection elements of one row may further be alternately disposed at least partially on opposite sides of a geometric separation surface. By way of example, FIGS. 19 and 20 show a row of consecutive projection elements 32, preferably in the form of teeth, including two series 32*a* and 32*b* located respectively on opposite sides of a geometric separation surface S. In this instance, the geometric separation surfaces S is a plane. The teeth 32*a* are located intermediate the teeth 32*b*, preferably midway between two adjacent teeth 32*b*, and vice versa, when the base portion is viewed from the side.

This alternating arrangement of projection elements makes it possible to contain the product between three consecutive projection elements while at the same time allowing the product to be smoothed along the eyelashes by virtue relatively narrow interstices 34 formed between two consecutive projection elements.

In the example of FIGS. 19 and 20, the roots of the teeth 32*a* and 32*b* are disposed respectively one on each side of the geometric separation surface S.

As an alternative, the roots of the teeth or projection elements may be substantially aligned and the teeth may have upper portions extending from the roots offset alternately at least partially on opposite sides of a geometric separation surface.

Figure 21:
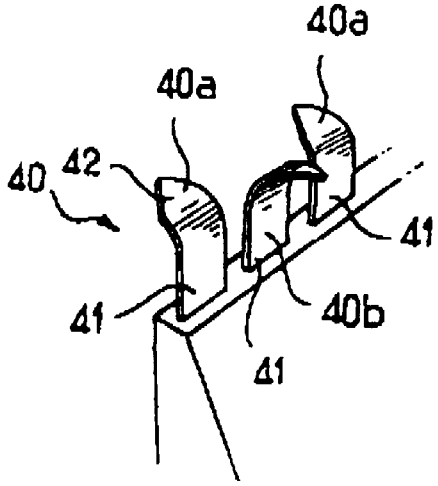
FIG. 21 is a partial perspective view of a base portion of an application element and a row of consecutive projection elements having substantially aligned portions and portions alternately offset on opposite sides of a geometric separation surface.

By way of example, FIG. 21 shows a row 40 of consecutive teeth 40*a* and 40*b*, the roots 41 of which are substantially aligned and the upper free ends 42 of which are respectively curved to the left and to the right when the application element is viewed from an end of the base portion.

Figure 22:
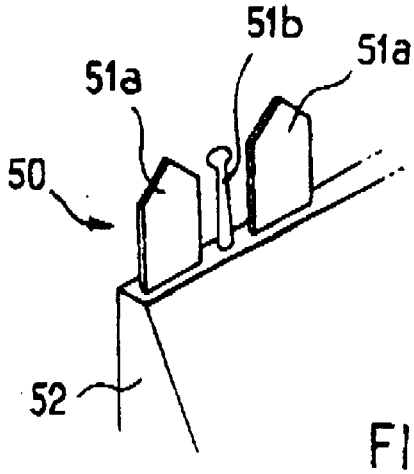
FIG. 22 is a partial perspective view of a base portion of an application element and a row of consecutive projection elements made up of an alternation of elements of different configurations.

The row of projection elements may include a mixture of bristles and teeth, or have teeth or bristles of different shapes. By way of example, FIG. 22 shows a row 50 of consecutive projection elements disposed substantially in the continuation of a side of the base portion 52. This row 50 includes an alternation of teeth 51*a* and bristles 51*b*.

Figure 23:
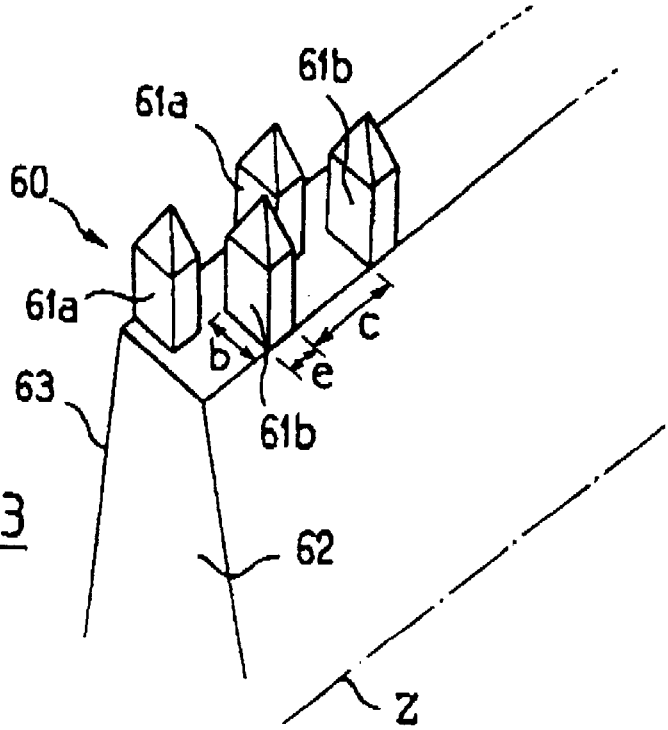
FIG. 23 is a partial perspective view of a row of consecutive projection elements disposed on a base portion of an application element according to yet another aspect of the present invention.

Especially, when the product applied to the eyelashes is likely to dry quickly, it may be preferable to use one row of teeth which are at least partially offset alternately on each side of a geometric separation surface with roots having a larger depth than width. By way of example, FIG. 23 shows a row 60 of teeth 61*a* and 61*b* alternately disposed on opposite sides of a geometric separation surface, which in this instance is a plane parallel to the side 63 of the base portion 62. The row of consecutive teeth 60 extends substantially in continuation of the side 63.

The depth b of the teeth is measured in a direction perpendicular to the longitudinal axis Z of the base and the width e is measured in a direction parallel to the axis Z. A gap c between two adjacent teeth 61*a* or 61*b* disposed on the same side of the geometric separation surface is measured parallel to the axis Z.

The teeth 61*a* and 61*b* may have various configurations, as illustrated in FIGS. 24–29, which show various arrangements of two consecutive teeth 61*a* and 61*b* having respective roots 64*a* and 64*b* and respective upper portions 65*a* and 65*b* extending from the roots 64*a* and 64*b*.

Figure 24:
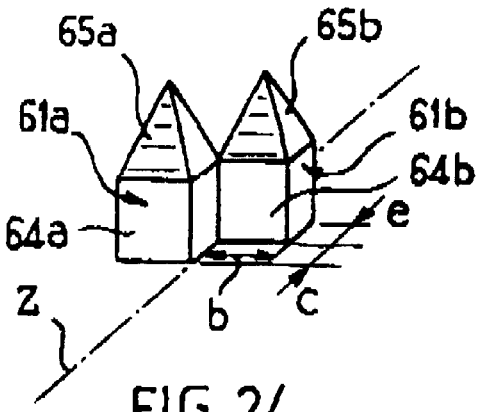
FIG. 24 is a perspective view of two consecutive projection elements having free ends substantially parallel to one another according to an aspect of the present invention.

In the configuration of FIG. 24, the upper portions 65*a* and 65*b*, especially the free ends, are coaxial the roots 64*a* and 64*b*, respectively. The free ends of each of the two consecutive teeth extend substantially parallel to one another.

Figure 25:
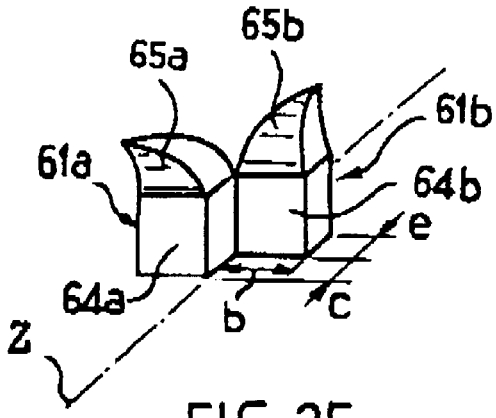
FIG. 25 is a perspective view of two consecutive projection elements having free ends facing opposite ends of the base portion from one another according to an aspect of the present invention.

In the configuration of FIG. 25, the upper portions 65*a* and 65*b*, especially the free ends, are inclined forward and backward respectively. That is, the free ends of each of the teeth are inclined toward opposite ends of the base portion.

Figure 26:
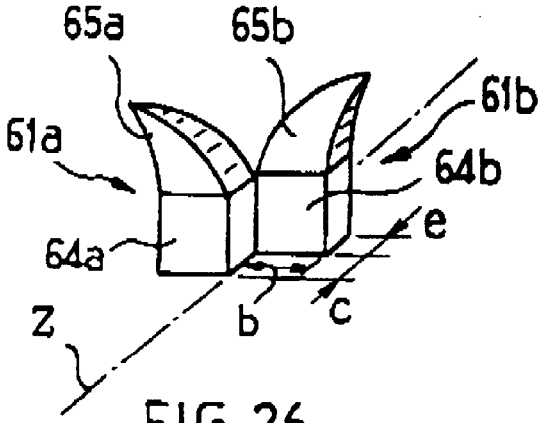
FIG. 26 is a perspective view of two consecutive projection elements having free ends diverging away from one another according to an aspect of the present invention.

In the configuration of FIG. 26, the upper portions 65*a* and 65*b*, especially the free ends, are inclined to the left and to the right, respectively, when the base portion is viewed from one of its ends. That is, the upper portions of the two consecutive teeth diverge away from one another.

Figure 27:
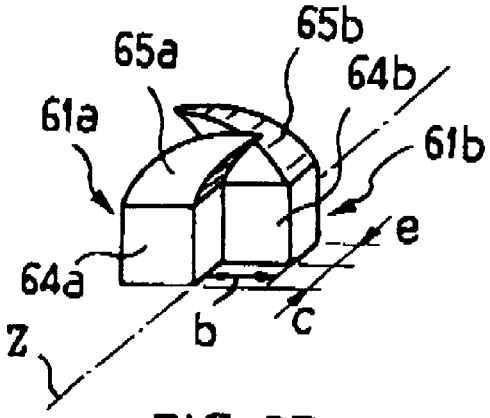
FIG. 27 is a perspective view of two consecutive projection elements having free ends converging toward and crossing one another according to an aspect of the present invention.

In the configuration of FIG. 27, the upper portions 65*a* and 65*b* are inclined to the right and to the left respectively and cross one another when the base portion is viewed from one of its ends. Alternatively, the upper portions could converge toward one another without crossing each other.

In an alternative form which has not been depicted, the upper portions of the teeth are, in addition to being inclined to the left and to the right respectively, the upper portions also may be inclined forward and backward respectively, or vice versa.

Figure 28:
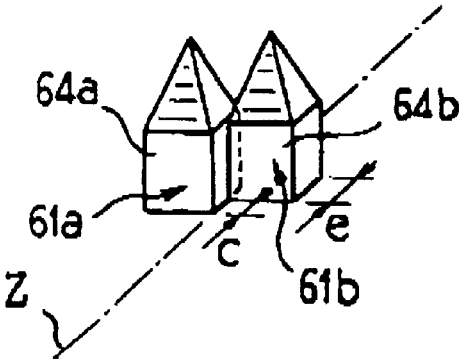
FIG. 28 is a perspective view of two consecutive projection elements having overlapping faces extending in a direction substantially parallel to a longitudinal axis of a base portion of an application element according to an aspect of the present invention.
Figure 29:
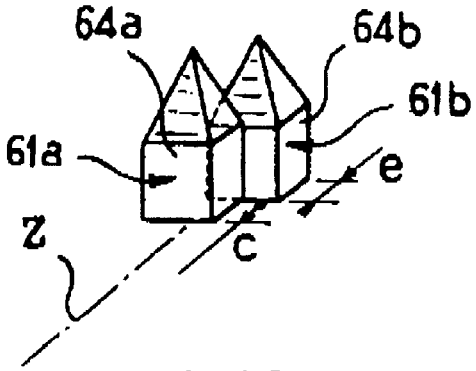
FIG. 29 is a perspective view of two consecutive projection elements having overlapping faces extending in a direction substantially perpendicular to a longitudinal axis of a base portion of an application element according to an aspect of the present invention.

In the configuration of FIG. 28, the roots of the teeth 64*a* and 64*b* overlap along faces extending substantially parallel the axis Z of the base portion. In the configuration of FIG. 29, the roots 64*a* and 64*b* of the teeth overlap along faces extending substantially perpendicular to the axis Z of the base portion.

Figure 30:
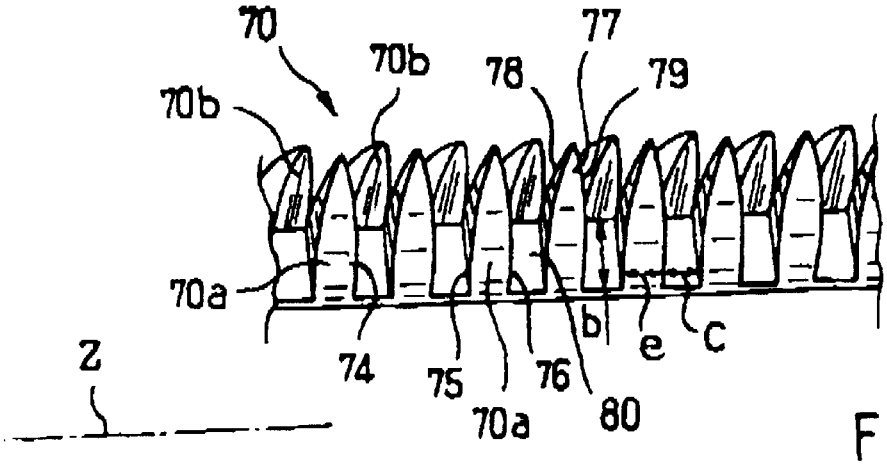
FIG. 30 is a partial perspective view of an application element having a row of consecutive projection elements disposed alternately on opposite sides of a geometric separation surface and having adjacent projection elements on the same side of the separation surface spaced apart from one another according to an aspect of the invention.
Figure 31:
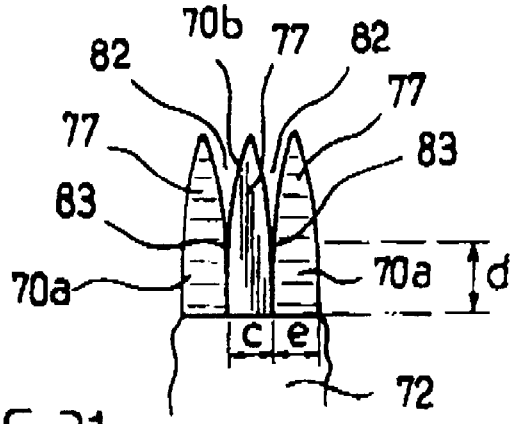
FIG. 31 is a side view of three consecutive projection elements of FIG. 30.
Figure 32:
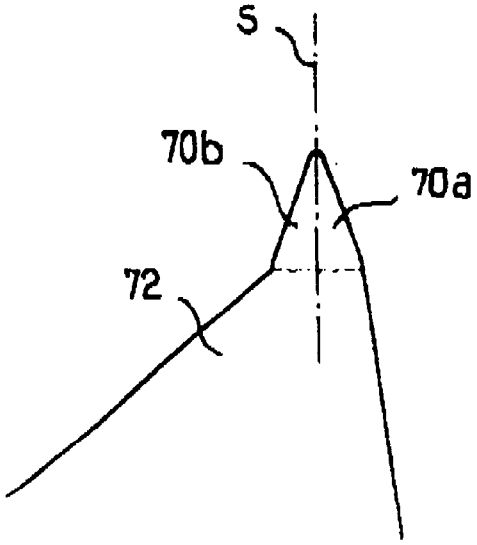
FIG. 32 is a view taken along the length of a base portion of the application element of FIG. 30.

FIGS. 30–32 show a row 70 of projection elements, this row 70 including a first series of teeth 70*a* and a second series of teeth 70*b*. The teeth preferably are molded as a single piece with a base portion 72 and disposed alternately on opposite sides of a geometric separation surface S, as can be seen in FIG. 32.

The envelope (i.e., outer peripheral surface) of the row 70 of teeth forms a cylinder with a substantially triangular directrix, as can be seen in FIG. 32. The depth b of the teeth 70*a* and 70*b* at the point where they meet the base portion 72 is larger than their width e and also longer than the gap c between two adjacent teeth 70*a* or 70*b* disposed on the same side of the geometric separation surface.

Preferably, a ratio of the gap separating two adjacent teeth on the same side of the geometric separation surface and the width of the tooth disposed on the opposite side of the geometric separation surface and intermediate the two adjacent teeth ranges from approximately 0.2 to 2.0, with the gap and the width preferably being measured approximately at a mid-portion of the height of the teeth.

Due to their relatively deep roots, the teeth 70*a* and 70*b* may be capable of withstanding a strain, such as from the eyelashes for example, exerted transversely to the axis Z of the base portion. This may allow the eyelashes to be separated and the product deposited at the surface of the eyelashes to be smoothed, even if the product has partially dried.

Each tooth 70*a* or 70*b* has a lower portion 74 with a practically planar and parallel front face 75 and rear face 76 facing perpendicular to the axis Z, and an upper portion 77 with a front face 78 and a rear face 79 converging toward the free end of each tooth. This provides the upper portion 77 of each tooth with an overall tapered configuration when the application element is viewed from the side, as in FIG. 31. The term front in this context means facing a distal end of the application element (or base portion), and the term rear means facing a proximal end of the application element (or base portion) and the stem when the application element is attached to the stem.

The lower portions 74 of three consecutive teeth of the row 70 define between them and with the base portion 72 a volume 80 configured to contain some product for depositing on the eyelashes.

The lower portions 74 of at least two consecutive teeth preferably are substantially contiguous, as best shown in FIG. 31.

The upper portions 77 of the substantially contiguous teeth form between them, when the application element is viewed from the side as in FIG. 31, forks allowing the lashes to be gripped, separated, combed, and the product deposited at the surface of the lashes to be smoothed.

More specifically, the upper portions 77 of the teeth form between them, when the application element is viewed from the side interstices in the form of notches 82, preferably V-shaped notches. The bottoms 83 of the notches are a distance d from the base portion 72, this distance d preferably being greater than or equal to approximately 0.2 mm from the base portion.

In the embodiment described, the distance d is on the order of 2 mm and the overall height of the teeth is on the order of 3 mm.

It will be understood that by altering the height of the teeth, the distance d, and the gap c, it may be possible to modify the amount of product with which the application element becomes laden.

Moreover, the gaps between adjacent teeth in the same series of teeth, i.e., 70*a* or 70*b*, may be relatively great to increase the amount of product with which the application element becomes laden, without negatively affecting the ability of application element to grip the eyelashes. This is because of the offset of the consecutive teeth and the fact that the notches 82 formed by the upper portions 77 of the consecutive teeth remain sufficiently narrow.

Figure 33:
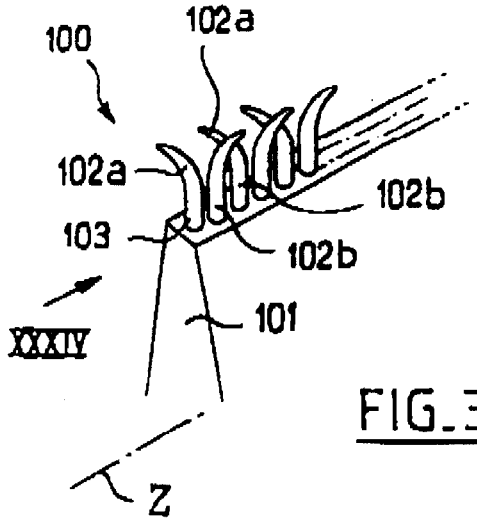
FIG. 33 is a partial perspective view of a row of consecutive projection elements disposed on a base portion of an application element according to an aspect of the present invention.
Figure 34:
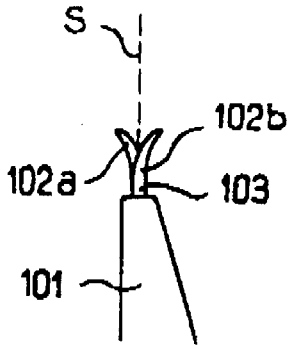
FIG. 34 is a view in the direction of arrow XXXIV of the application element of FIG. 33.

FIG. 33 shows a row 100 of consecutive teeth made as a single piece by molding plastic with a base portion 101 of axis Z.

The row 100 includes two series of teeth 102*a* and 102*b* arranged in alternation as has been described. The roots 103 of the teeth are substantially aligned with one another in a direction parallel to the axis Z of the base portion 101. The upper portions are alternately disposed respectively on opposite sides of a geometric separation surface S, which in this instance is a plane extending substantially parallel to the roots 103 of the teeth.

The height of the roots 103 of the teeth preferably is on the order of one to a few millimeters in the example described, preferably being greater than or equal to approximately 0.2 mm.

By virtue of the alternate disposition of the upper portions of the teeth, it may be possible to have a zero or very small spacing between the roots 103. For example, the spacing may be smaller than or equal to approximately 0.4 mm.

Two consecutive teeth form notches between them allowing the application element to grip the eyelashes, whereas the offset upper portions of the teeth form between them volumes capable of containing the product. It preferably is possible to obtain both a substantial amount of product on the application element and to achieve the gripping of the eyelashes, thus potentially improving the overall quality of the application and of the makeup effects.

By altering the tooth geometry and spacing, the amount of product contained on the applicator element may be changed.

Figure 35:
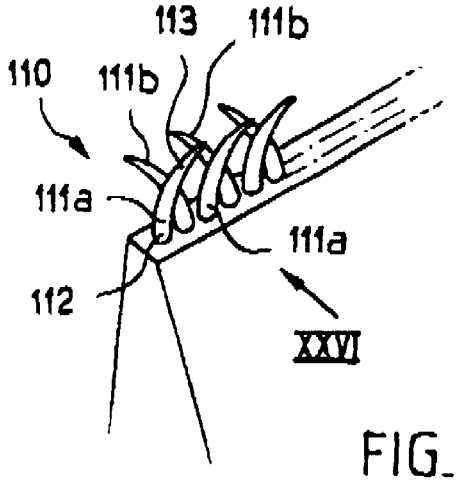
FIG. 35 is a partial perspective view of a row of consecutive projection elements disposed on a base portion of an application element according to yet another aspect of the present invention.
Figure 36:
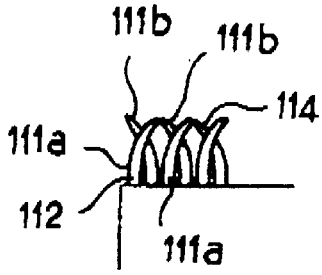
FIG. 36 is a side view in the direction of arrow XXXVI of the application element of FIG. 35.

FIGS. 35 and 36 show a row of consecutive teeth 110 including a first series of teeth 111*a* and a second series of teeth 111*b*. The roots 112 of the consecutive teeth are substantially aligned, while portions extending from the roots of consecutive teeth are alternately disposed at least partially on opposite sides of a geometric separator surface.

For example, the upper portions 113 of the teeth 111*a* are oriented to the right and backward, while the upper portions of the teeth 111*b* are oriented to the left and forward when the application element is viewed from a front end and from the sides. In this manner, the upper portions 113 of the teeth 111*a* and 111*b* cross each other when the application element is viewed from the side as shown in FIG. 36.

The free ends 114 of the consecutive teeth, which cross each other, define notches between them for gripping the eyelashes, while the roots of the consecutive teeth define volumes for containing product between them.

Figure 37:
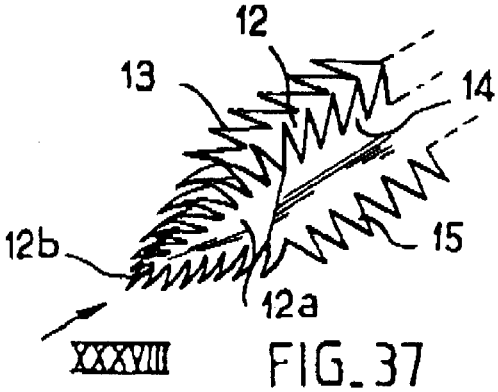
FIG. 37 is a partial perspective view of an application element with a tapered end according to an aspect of the present invention.
Figure 38:
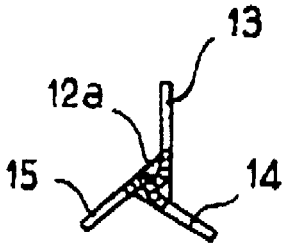
FIG. 38 is a view in the direction of arrow XXXVIII of the application element of FIG. 37.

As a preference, as illustrated in FIGS. 37 and 38, the application element may have a distal end with an overall tapered configuration, thus facilitating the insertion of the applicator into a container containing the product. In FIGS. 37 and 38 the base portion 12 has a front part 12*a* of tapered overall shape. The rows 13, 14 and 15 of elements extend along the corners of this tapered part 12*a* as far as the front tip 12*b* and have a height which decreases up to said tip.

In an alternative form, not shown, the rows of elements 13, 14 and 15 do not extend over the tapered front part.

Figure 39:
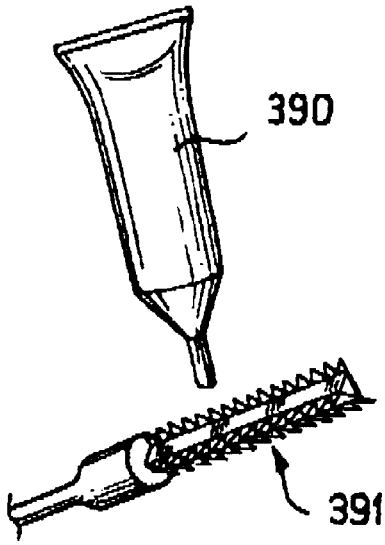
FIG. 39 is a perspective view of an embodiment of an applicator system according to the present invention wherein the product to be applied is dispensed onto the application member from a flexible tubular container.
Figure 40:
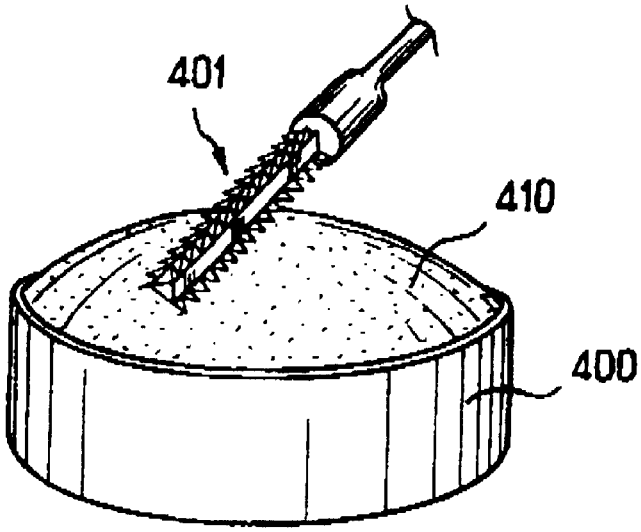
FIG. 40 is a perspective view of yet another embodiment of an applicator system according to the present invention wherein the product to be applied is in the form of a cake or powder.

Alternatives to the applicator system discussed with respect to FIG. 1 are shown in FIGS. 39 and 40. FIG. 39 illustrates an applicator system in which the product is stored in a tube-like container 390. This tube preferably is made of a flexible material which when squeezed can dispense product onto the application element 391 of the applicator. Other dispensers also can be used to dispense the product onto the application element, such as a pump-type dispenser for example, and are considered within the scope of the invention. The applicator system shown in FIG. 40 includes a container 400 holding a solid cake of product 410. To load the applicator, the application element 401 is run through this product 410. This solid cake preferably can be moistened and the application element 401 run through the moistened part of the product to load the product onto the applicator. Alternatively, the application element can be moistened and run through unmoistened product. For the embodiments shown in FIGS. 39 and 40, it is not necessary to equip the proximal end of the applicator device with a handle or a cap, as the applicator device is not stored in the container containing the product and does not close off such a container. Moreover, in these embodiments, the stem itself can be used as a handle.

Figure 41:
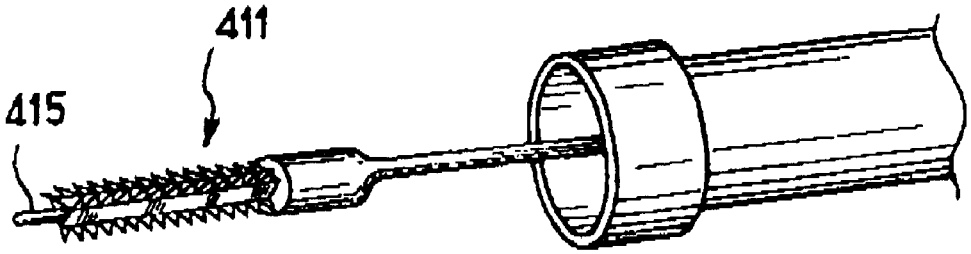
FIG. 41 is a perspective view of an applicator according to another aspect of the invention wherein the distal end of the application element includes a substantially pointed tip.

FIG. 41 illustrates yet another aspect of the applicator of the present invention. The applicator shown in FIG. 41 includes a pointed tip 415 extending from the distal end of the application element 411. Upon loading the application element 411 with product, the pointed tip 415 may also become loaded with product and can serve as a tool to line the eyes or as a picking device to pick through individual lashes.

Figure 42:
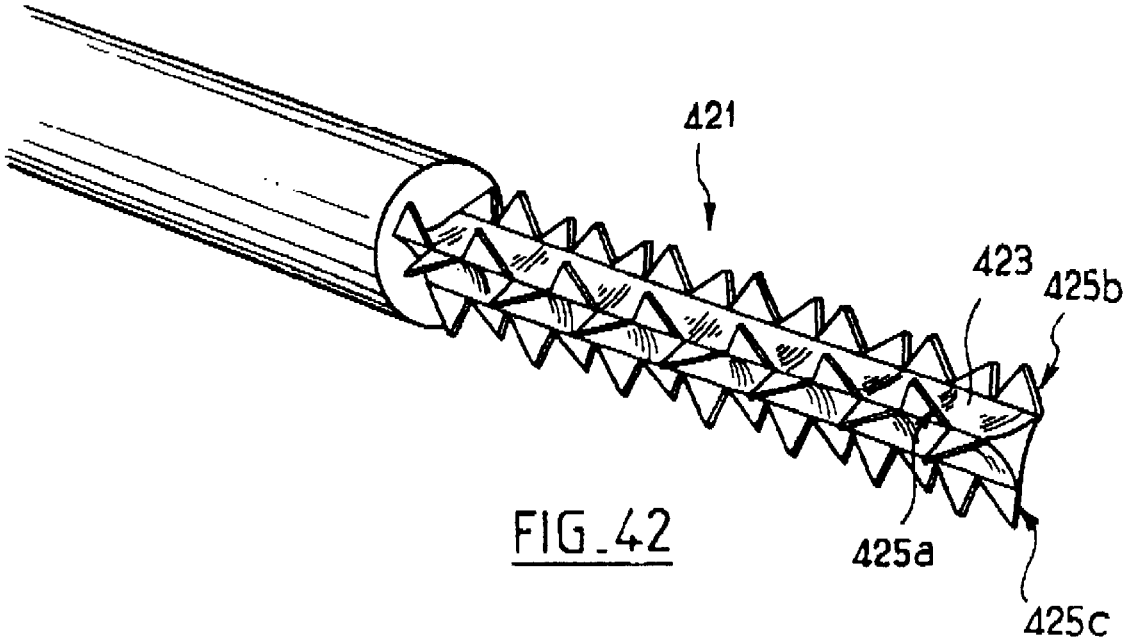
FIG. 42 is a partial perspective view of an applicator having an application element including a substantially triangular shaped base portion with concave sides and a row of substantially planar consecutive alternating projection elements according to an aspect of the present invention.
Figure 43:
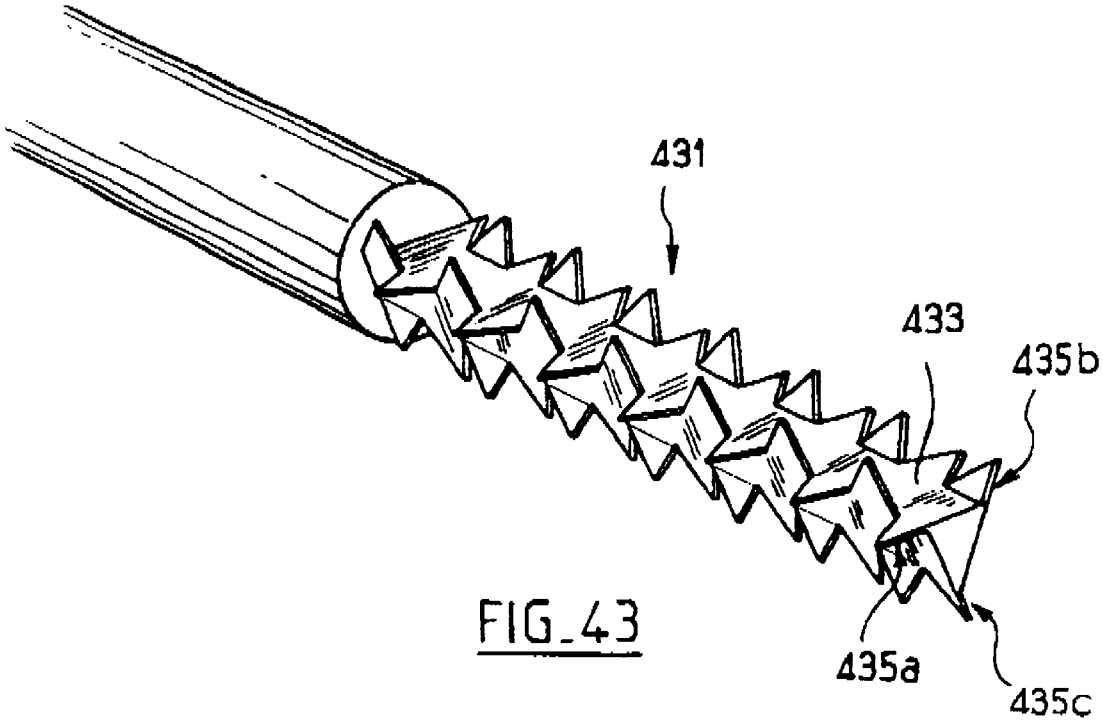
FIG. 43 is a partial perspective view of an applicator similar to that of FIG. 44 except having a base portion with planar sides according to an aspect of the present invention.

FIGS. 42 and 43 each show applicators having application elements 421, 431 with base portions 423, 433 of substantially triangular cross-section. However, the base portion 423 in FIG. 42 has non-planar sides which are concave, whereas the base portion 433 in FIG. 43 has planar sides. Each application element 421, 431 includes three projection members in the form of three rows of consecutive projection elements 425*a*–425*c,* and 435*a*–435*c.* The consecutive projection elements in each row have substantially contiguous portions at corners of consecutive elements. The projection elements of each row also have free end portions alternately disposed on opposite sides of a geometric separation surface. The projection elements are substantially planar (flat) elements.

Figure 44:
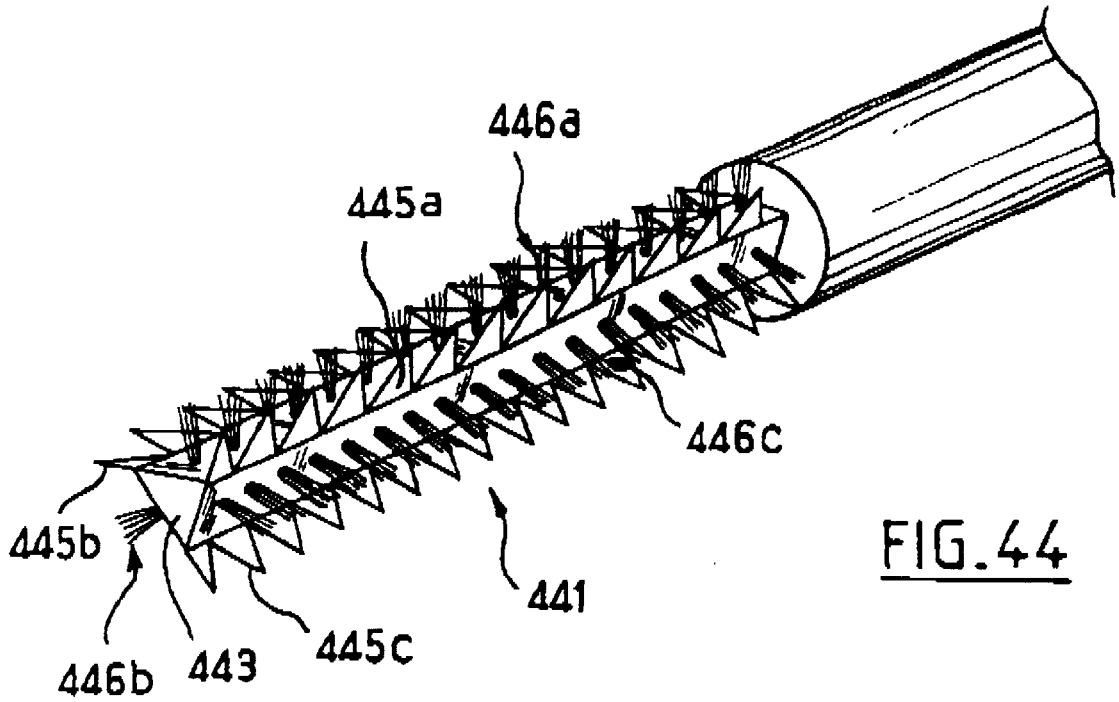
FIG. 44 is a partial perspective view of an applicator having bristles extending radially from sides of a base portion between rows of consecutive projection elements according to another aspect of the present invention.

FIG. 44 shows an applicator having a base portion 443 of the application element 441 similar in overall construction to the base portion 433 of the application element 431 in FIG. 43. However, the projection members on the base portion 443 include a row of consecutive projection elements which do not have portions alternately disposed on opposite sides of a geometric separation surface. Rather the projection elements of each row 445*a,* 445*b,* 445*c* are substantially aligned with one another along the length of the base portion 443. The application element 441 also includes a plurality of rows of consecutive bristles 446*a*–446*c,* each row being disposed on a side of the base portion 443 between adjacent rows of projection elements. The rows of bristles extend substantially radially from respective sides of the base portion.

FIGS. 45–50 each show application elements having base portions of polygonal cross-section with a plurality of projection members extending substantially in continuation of different sides of the base portion. Adjacent projection members, as shown in these figures, also extend away from the respective base portions in substantially different directions and are oriented in substantially the same direction of gyration about a longitudinal axis of the base portion. The projection members are serrated on their free edges to provide a gripping effect on the eyelashes as the eyelashes pass therethrough.

The application element of FIG. 45 includes a base portion 453 having a substantially uniform square cross section and four projection members 455*a*–455*d* extending from the base portion. In FIG. 45, a plurality of reliefs 457 are disposed such that they extend from a side of the base portion 453 along a projection element adjacent to, but not in continuation with, the side.

The application element of FIG. 46 includes a base portion 463 of non-uniform triangular cross section with three projection members 465*a*–465*c* extending therefrom. Moreover, the projection members each have a substantially concave free edge facing outward. The curvature of the free edge preferably is adapted to the curvature of an eyelid.

FIG. 47 shows an application element with a base portion 473 of non-uniform triangular cross-section with three projection members extending in continuation of the respective sides of the base portion. The projection members 475*a*–475*c* each have a substantially convex free edge facing outward.

Figure 48:
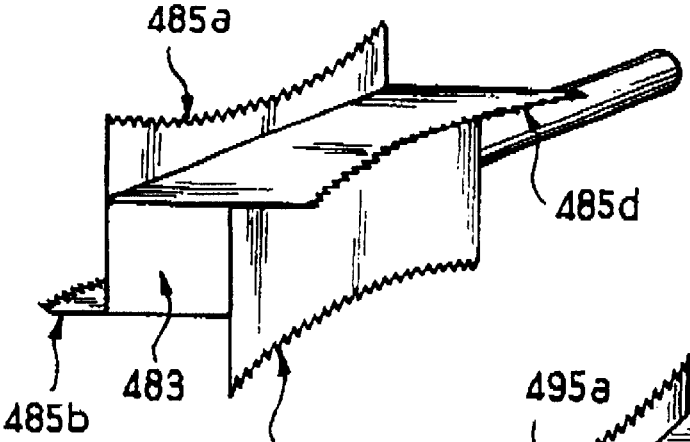
FIG. 48 is a partial perspective view of an applicator having an application element with a base portion of substantially uniform square cross-section and serrated projection members varying in height along a length of the base portion according to an aspect of the invention.

FIG. 48 shows an application element with a base portion 483 having a uniform square cross section. Four projection members 485*a*–485*d* are disposed substantially in continuation of each of the respective sides of the base portion 483. The projection members in FIG. 48 each have a height varying along a length of the base portion 483.

Figure 49:
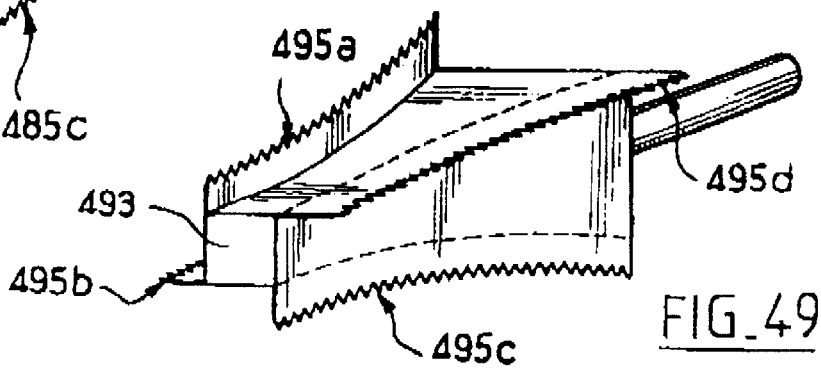
FIG. 49 is a partial perspective view of an applicator having an application element with a base portion of square cross-section that tapers from a proximal end to a distal end and four serrated projection members disposed on the base portion according to an aspect of the invention.

FIG. 49 shows an application element with a base portion 493 having a non-uniform square cross-section. The base portion 493 is tapered from a proximal end of the application element to a distal end of the application element. Four projection members 495*a*–495*d* are disposed on the base portion substantially in the continuation of the respective sides of the base portion 493.

Figure 50:
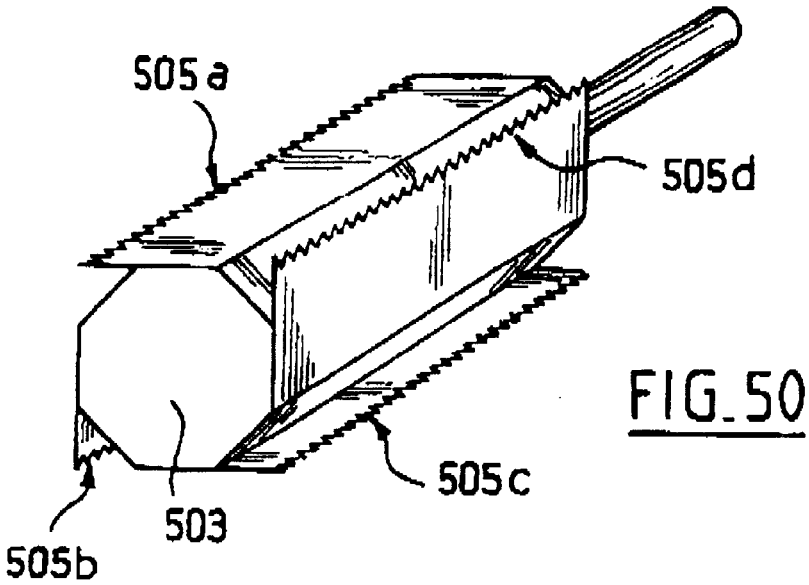
FIG. 50 is a partial perspective view of an applicator having an application element with a base portion of substantially uniform octagonal cross-section and serrated projection members according to an aspect of the invention.

FIG. 50 shows an application element having a base portion 503 of uniform octagonal cross section with four projection members 505*a*–505*d* extending respectively from two pairs of opposite sides of the base portion 503. The projection members extending from a pair of opposite sides are directed away from the base portion in opposite directions from one another.

Figure 51:
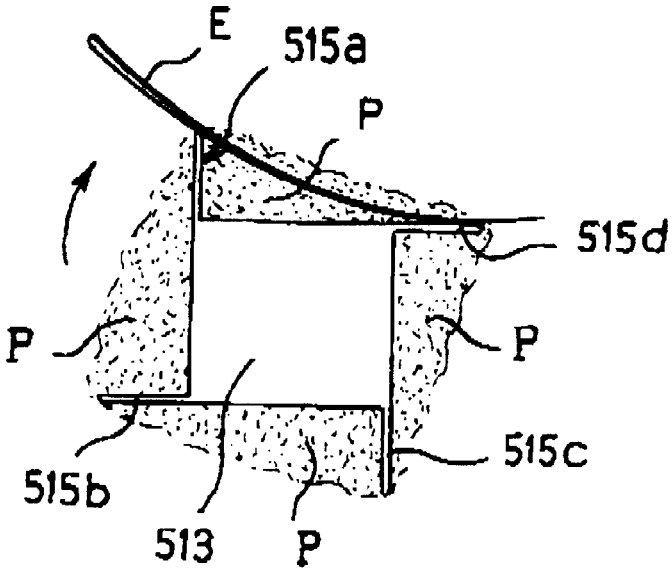
FIG. 51 is a cross-sectional view of an application element loaded with product and in contact with an eyelash to apply the product to eyelashes according to an aspect of the present invention.

FIG. 51 illustrates an example of how an applicator according to an aspect of the present invention contains the product P in substantially open volumes formed in part between each projection member 515*a*–515*d* and an adjacent side of the base portion other than the side from which the projection member extends substantially in continuation. As shown, the volume of product held between respective projection members 515*a*–515*d* and corresponding adjacent sides is such that a relatively large amount of product is contained near the projection member with the amount of product tapering off along the adjacent side and toward a projection member extending in continuation of that adjacent side. The height of the product contained on the applicator preferably is approximately equal to the height of the projection member that is not extending in continuation of the adjacent side with which the projection member forms the volume (i.e., projection member 515*a* in FIG. 51, for example). The height of the product preferably decreases from the projection member where the amount of product in. the volume is largest, along the length of the adjacent side, and toward a projection member extending in continuation of that adjacent side (i.e., projection member 515*d* in FIG. 51, for example).

The configuration of the application element allows the eyelashes E to come into contact with the product contained in an open volume and become coated with the product as the side defining part of the volume is moved substantially parallel to the eyelash E. As the applicator is rotated, the eyelash may then come into contact with a corresponding projection member, for example projection member 515*a* shown in FIG. 51, which may then smooth the product along the length of the eyelash and also lengthen and curl the eyelash. Preferably, to improve lengthening and curling, the projection member also will have portions able to grip the eyelashes as has been discussed above. As shown in FIG. 51, by providing a plurality of projection members, a plurality of volumes containing product can be formed, thus the steps discussed above of first contacting the eyelash with the volume of product to coat the eyelash and then contacting the eyelashes with the projection member to smooth the product and lengthen the eyelash can be repeated a number of times. This may allow the product to be applied to the eyelashes without the need to reload the applicator frequently.

In each of the embodiments shown in FIGS. 45–50, both the height of the projection members and the depth of the serrations on the free edge of the projection members can be altered as desired to achieve differing effects. For example, by modifying the height of the projection member, the amount of product held between the projection member and the adjacent side of the base portion, as described with reference to FIG. 51, can be either increased or decreased. Also, by modifying the depth of the serrations on a free edge of the projection member, the proximity of the eyelashes to the base portion of the application element during application of the product to the eyelashes can be controlled. That is, by forming relatively deep serrations in the free edge of the projection member, the eyelashes can be brought relatively close to the base portion during application.

Figure 52:
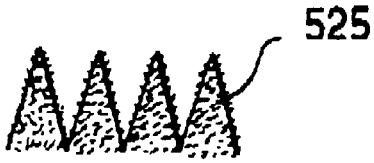
FIG. 52 is a side view of flocked projection members according to an aspect of the invention.

FIG. 52 shows a projection member in the form of a row of consecutive projection elements 525 having flocking thereon.

The invention is not restricted to the examples and embodiments just described. Rather, it is possible for at least some of the features of these examples and embodiments to be combined into one and the same applicator. In general, the particular features of each of the embodiments described may be combined, according to the type of product to be applied and the application effect desired.

For example, the projection members and elements may have shapes other than those that have been described and the projection members or elements on a particular application element or the elements in a particular row need not have the same shape as each other. For example, the application element may include a row of consecutive teeth including a first and a second series of teeth alternately disposed as has been described where the teeth of the first series having a different shape than the teeth of the second series.

Moreover, projection elements in the same series also may have differing shapes and/or sizes, and/or different heights, for example. The projection members or elements may, for example, have a height which varies according to an axial position along the length of the base portion, for example a height which increases, decreases, decreases then increases or increases then decreases from one end of the base portion to the other.

Projection members or projection elements may also have hollow portions with an opening in a side of the member or element in product flow communication with the hollow portions. These hollow portions can become filled with product, thus allowing the applicator to hold even more product to coat the eyelashes with.

The application element may have a surface condition to increase the amount of product with which the application element becomes laden. For instance, the projection member, including the projection elements and/or the base portion may include capillary grooves or flocking, over all or parts of their surface. An example of such flocking on the teeth is shown in FIG. 52.

The projection members or elements may undergo a surface treatment by abrasion so as to form forks at the ends of the teeth, for example or may undergo a heat treatment to, for example, round their tips or form a bobble at their free end. The projection members thus become less aggressive toward the eyelashes.

Any or all portions of the application element may be coated with a gliding agent, such as a lacquer or Teflon, for example, to provide better gliding along the eyelashes or, alternatively, to provide a greater roughness. Such gliding agents may alternatively, or in addition, be added to the material used to form the application element.

The application element, and especially the projection members, may also include active ingredients, such as preservatives, moisturizers, copper salts, magnetic particles, and other similar suitable materials, to be released into the product when the product is loaded onto the application element. These active ingredients can either be included in the material used to form the application element, or can be coated onto the application element, or both. In addition, products can be used to form the parts of the application element or to coat parts of the application element that modify the surface tension of the application element upon contact with moisture.

The application element is preferably made by the injection-molding of plastic, but as an alternative, use may be made of methods for shaping material by compression, stamping or turning. The projection members may be made of a different material than that used to make the base portion or the portion of the application element on which they are disposed. Also, the application element and stem may be made of two different materials.

The base portion may also include grooves or reliefs configured to hold the product.

Although numerous configurations for the projection members and base portion are contemplated by the invention, in each of the embodiments described, preferably the length of a row of consecutive projection elements or the length of the projection member will range from approximately 10 mm to approximately 45 mm, and more preferably from approximately 15 mm to approximately 28 mm, and even more preferably from approximately 20 mm to approximately 26 mm. The individual heights of each projection member or projection element will preferably range from approximately 0.5 mm to approximately 15 mm, and more preferably from approximately 7 mm to approximately 13 mm. The number of projection elements in a row of consecutive projection elements will preferably range from approximately 6 to approximately 50, and more preferably from approximately 10 to approximately 35, and even more preferably approximately 15 to approximately 32.

It will be apparent to those skilled in the art that various modifications and variations can be made to the structure and methodology of the present invention without departing from the scope or spirit of the invention. Thus, it should be understood that the invention is not limited to the embodiments and examples discussed in the specification. Rather, the present invention is intended to cover modifications and variations of this invention, provided they fall within the scope of the following claims and their equivalents.

What is claimed is:

1. An applicator for applying product to eyelashes, comprising:

a stem; and an application element on an end of the stem, said application element including a base portion having a polygonal cross-section and a plurality of sides, and a plurality of projection members disposed on said polygonal base portion, at least two of said projection members extending away from the base portion substantially in continuation of different sides of the base portion and extending outward from the base portion in different directions from one another.

2. The applicator of claim 1, wherein at least one of the projection members includes a row of consecutive projection elements.

3. The applicator of claim 2, wherein the projection elements are chosen from teeth and bristles.

4. The applicator of claim 2, wherein the row of consecutive projection elements includes consecutive projection elements alternately disposed at least partially on opposite sides of a geometric separation surface.

5. The applicator of claim 4, wherein at least two consecutive projection elements in the row of consecutive projection elements have portions substantially aligned with one another.

6. The applicator of claim 5, wherein upper portions of the at least two consecutive projection elements are chosen from one of diverging away from one another, converging toward one another, crossing one another, and extending substantially parallel to one another when the application element is viewed along a longitudinal axis of the base portion.

7. The applicator of claim 5, wherein the geometric separation surface passes through a plane of alignment of the substantially aligned portions of the at least two consecutive projection elements.

8. The applicator of claim 5, wherein the at least two consecutive projection elements include teeth having aligned roots and the height of each of the roots of the at least two consecutive teeth is at least approximately 0.2 mm.

9. The applicator of claim 5, wherein the at least two consecutive projection elements include teeth having roots with a larger depth larger than width.

10. The applicator of claim 4, wherein at least two consecutive projection elements have portions substantially contiguous with one another.

11. The applicator of claim 10, further comprising at least one notch defined between the at least two consecutive projection elements having substantially contiguous portions.

12. The applicator of claim 10, wherein upper portions of the at least two consecutive projection elements are chosen from one of diverging away from one another, converging toward one another, crossing one another, and extending substantially parallel to one another when the application element is viewed along a longitudinal axis of the base portion.

13. The applicator of claim 10, wherein the at least two consecutive projection elements include upper portions directed toward opposite ends of the base portion.

14. The applicator of claim 10, wherein the substantially contiguous portions are overlapping portions.

15. The applicator of claim 4, wherein the geometric separation surface is a plane.

16. The applicator of claim 4, wherein the geometric separation surface is a parting line for the molding of the application element.

17. The applicator of claim 4, wherein the geometric separation surface is a cylindrical surface, the directrix of which is one of a curve and a broken line.

18. The applicator of claim 4, wherein the geometric separation surface is non-planar.

19. The applicator of claim 4, wherein at least two consecutive projection elements include upper portions directed toward opposite ends of the base portion.

20. The applicator of claim 4, wherein adjacent projection elements on the same side of the separation surface are separated from one another by a gap.

21. The applicator of claim 20, wherein a depth of each of the adjacent projection elements is greater than said gap, said depth being measured in a direction substantially perpendicular to a longitudinal axis of the base portion and said gap being measured in a direction substantially parallel to the longitudinal axis.

22. The applicator of claim 4, wherein the row of projection elements includes a first series of projection elements having faces facing one of the ends of the base portion and being inclined in one direction with respect to the longitudinal axis of the row, and a second series of projection elements, alternating with the first series of projection elements, having faces facing one of the ends of the base portion and being inclined in a different direction than the projection elements of the first series with respect to a longitudinal axis of the row.

23. The applicator of claim 4, wherein at least one of the projection elements has one of a convex and a concave face facing toward an end of the application element.

24. The application of claim 23, wherein at least two consecutive projection elements have a convex face and a concave face facing an end of the application element.

25. The applicator of claim 4, wherein one of two consecutive projection elements has one of a concave face and a convex face facing an end of the application element and the other of the two consecutive projection elements has a planar face facing the end of the application element.

26. The applicator of claim 2, wherein the base portion is substantially elongate and the row of consecutive projection elements extends along the length of the base portion.

27. The applicator of claim 2, wherein the projection elements have a height ranging from approximately 0.5 mm to approximately 15 mm.

28. The applicator of claim 2, wherein the projection elements have a height ranging from approximately 7 mm to approximately 13 mm.

29. The applicator of claim 2, wherein the projection elements have differing heights.

30. The applicator of claim 2, wherein at least three consecutive projection elements of the row of consecutive projection elements define at least part of a volume configured to contain the product to be applied.

31. The applicator of claim 1, wherein the projection members are oriented in substantially the same direction of gyration about a longitudinal axis of the base portion.

32. The applicator of claim 1, wherein the base portion has a cross-section chosen from triangular, square, pentagonal, hexagonal, and octagonal.

33. The applicator of claim 1, wherein the base portion is substantially elongate and the projection members extend along the length of the base portion.

34. The applicator of claim 1, wherein the projection members have a serrated edge opposite to where the projection members meet the base portion.

35. The applicator of claim 1, wherein said different sides of the base portion are parallel to one another and face in opposite directions.

36. The applicator of claim 1, wherein the stem is produced from molding.

37. The applicator of claim 36, wherein the stem is produced by molding plastic.

38. The applicator of claim 1, wherein the stem is a non-twisted wire stem.

39. The applicator of claim 2, wherein the projection elements include at least one face facing an end of the base portion, said at least one face being disposed at an angle to a longitudinal axis of the base portion.

40. The applicator of claim 39, wherein the angle is one of pependicular to, acute to, and obtuse to the longitudinal axis.

41. The applicator of claim 1, wherein the projection members and the base portion are molded together as a single piece.

42. The applicator of claim 41, wherein the projection members and the base portion are molded together using plastic.

43. The applicator of claim 1, wherein a height of the projection member ranges from approximately 7 mm to approximately 13 mm.

44. The applicator of claim 1, wherein the application element is removably connected to a distal end portion of the stem.

45. The applicator of claim 1, wherein a longitudinal axis of the base portion extends substantially parallel to a longitudinal axis of the stem.

46. The applicator of claim 1, wherein each projection member and an adjacent side of the base portion, other than the side from which the projection member extends substantially in continuation, define an open volume configured to contain product to be applied.

47. The applicator of claim 1, wherein the base portion has a substantially uniform cross-section over at least a portion of its length.

48. The applicator of claim 1, wherein the cross-section of the base portion is chosen from a regular polygon and an irregular polygon.

49. The applicator of claim 1, wherein at least one of the sides of the polygon is non-planar.

50. The applicator of claim 1, wherein a height of the projection member ranges from approximately 0.5 mm to approximately 15 mm.

51. The applicator of claim 1, wherein a height of the projection member varies along a length of the base portion.

52. An applicator system comprising:

the applicator of claim 1; and a container configured to contain the product.

53. The system of claim 52, further comprising:

a wiper configured to remove excess product from the projection members when the applicator is removed from the container.

54. The system of claim 53, wherein the wiper is deformable.

55. The system of claim 54, where n the wiper is chosen from a block of foam and an elastomeric lip.

56. The system of claim 52, wherein the product is contained in the container and the product is a cosmetic product for the eyelashes.

57. The system of claim 56, wherein the product is mascara.

58. The system of claim 52, wherein the container includes an opening configured to permit passage of at least a part of the application element into the container, and wherein the system further comprises a cap at another end of the stem, the cap being configured to sealably close the opening.

59. A method for applying a product to eyelashes, comprising:

providing the applicator of claim 1;

loading a product on at least a part of the application element; and placing at least a part of the application element in contact with the eyelashes such that the product coats the eyelashes.

60. The method of claim 59, wherein the loading includes inserting the applicator into a container containing the product.

61. The method of claim 60, further comprising removing the applicator from the container and wiping excess product from the application element.

62. The method of claim 59, wherein the loading includes dispensing the product from the container onto the application element.

63. The method of claim 59, wherein the loading includes contacting the application element with a solid cake of product.

64. The method of claim 63, further comprising moistening the solid cake of product.

65. The method of claim 59, further comprising gripping the eyelashes with at least part of the application element.

66. The method of claim 59, wherein the product is mascara.

67. The method of claim 66, wherein the mascara includes fibers, and wherein the method further comprises orienting the fibers with the application element such that the fibers are substantially parallel to the eyelashes as the product is applied.

68. The method of claim 59, further comprising connecting a portion of the application element of the applicator to the stem of the applicator.

69. The method of claim 68, further comprising selecting an application element from a plurality of application elements and connecting the application element to the stem.

70. The method of claim 59, wherein the placing includes contacting the eyelashes first with product loaded on the base portion of the application element and then with the product loaded on one of the projection members of the application element.

71. The applicator of claim 1, wherein the at least two projection members are adjacent to one another.

72. The applicator of claim 1, wherein the at least two projection members are substantially parallel to one another.

73. The applicator of claim 1, wherein the at least two projection members are not substantially parallel to one another.

74. The applicator of claim 1, wherein each of the projection members is a row of consecutive projection elements.

75. The applicator of claim 74, wherein the projection elements are chosen from teeth an bristles.

76. The applicator of claim 1, wherein the projection members extend from to the application element at origination locations spaced from a longitudinal axis of the base portion.

77. The applicator of claim 1, wherein the application element lacks a twisted wire.

78. The applicator of claim 1, wherein the base portion includes solid sides.

79. The applicator of claim 1, wherein the base portion is a single piece, integral structure.

80. The applicator of claim 79, wherein the base portion is a molded structure.

81. An applicator for applying product to eyelashes, comprising:

a stem; and an application element on an end of the stem, said application element including a base portion having a non-polygonal cross-section, and at least one projection member disposed on said base portion and extending away from the base portion such that an axis of the projection member is in a direction substantially at a tangent to the base portion where the projection member meets the base portion.

82. The applicator of claim 81, wherein the at least one projection member includes a row of consecutive projection elements.

83. The applicator of claim 82, wherein the projection elements are chosen from teeth and bristles.

84. The applicator of claim 82, wherein the row of consecutive projection elements includes consecutive projection elements alternately disposed at least partially on opposite sides of a geometric separation surface.

85. The applicator of claim 84, wherein at least two consecutive projection elements in the row of consecutive projection elements have portions substantially aligned with one another.

86. The applicator of claim 85, wherein upper portions of the at least two consecutive projection elements are chosen from one of diverging away from one another, converging toward one another, crossing one another, and extending substantially parallel to one another when the application element is viewed along a longitudinal axis of the base portion.

87. The applicator of claim 85, wherein the geometric separation surface passes through a plane of alignment of the substantially aligned portions of the at least two consecutive projection elements.

88. The applicator of claim 85, wherein the at least two consecutive projection elements include teeth having aligned roots and the height of each of the roots of the at least two consecutive teeth is at least approximately 0.2 mm.

89. The applicator of claim 85, wherein the at least two consecutive projection elements include teeth having roots with a larger depth larger than width.

90. The applicator of claim 84, wherein at least two consecutive projection elements include upper portions directed toward opposite ends of the base portion.

91. The applicator of claim 84, wherein at least two consecutive projection elements have portions substantially contiguous with one another.

92. The applicator of claim 91, further comprising at least one notch defined between the at least two consecutive projection elements having substantially contiguous portions.

93. The applicator of claim 91, wherein free ends of the at least two consecutive teeth are chosen from one of diverging away from one another, converging toward one another, crossing one another, and extending substantially parallel to one another when the application element is viewed along a longitudinal axis of the base portion.

94. The applicator of claim 91, wherein the at least two consecutive projection elements include free ends directed toward opposite ends of the base portion.

95. The applicator of claim 91, wherein the substantially contiguous portions are overlapping portions.

96. The applicator of claim 84, wherein the geometric separation surface is a plane.

97. The applicator of claim 84, wherein the geometric separation surface is a parting line for the molding of the application element.

98. The applicator of claim 84, wherein the geometric separation surface is a cylindrical surface, the directrix of which is one of a curve and a broken line.

99. The applicator of claim 84, wherein the geometric separation surface is non-planar.

100. The applicator of claim 84, wherein adjacent projection elements on the same side of the separation surface are separated from one another by a gap.

101. The applicator of claim 100, wherein a depth of each of the adjacent projection elements is greater than said gap, said depth being measured in a direction substantially perpendicular to a longitudinal axis of the base portion and said gap being measured in a direction substantially parallel to the longitudinal axis.

102. The applicator of claim 84, wherein the row of projection elements includes a first series of projection elements having faces facing one of the ends of the base portion and being inclined in one direction with respect to the longitudinal axis of the row, and a second series of projection elements, alternating with the first series of projection elements, having faces facing one of the ends of the application element and being inclined in a different direction than the projection elements of the first series with respect to a longitudinal axis of the row.

103. The applicator of claim 84, wherein at least one of the projection elements has one of a convex and a concave face facing toward an end of the application element.

104. The application of claim 103, wherein at least two consecutive projection elements each has a convex face and a concave face facing an end of the application element.

105. The applicator of claim 84, wherein one of two consecutive projection elements has one of a concave face and a convex face facing an end of the application element and the other of the two consecutive projection elements has a planar face facing the end of the application element.

106. The applicator of claim 82, wherein the projection elements include at least one face facing an end of the base portion, said at least one face being disposed at an angle to a longitudinal axis of the base portion.

107. The applicator of claim 106, wherein the angle is one of perpendicular to, acute to, and obtuse to the longitudinal axis.

108. The applicator of claim 82, wherein the base portion is substantially elongate and the row of consecutive projection elements extends along the length of the base portion.

109. The applicator of claim 82, wherein the projection elements have a height ranging from approximately 0.5 mm to approximately 15 mm.

110. The applicator of claim 82, wherein the projection elements have a height ranging from approximately 7 mm to approximately 13 mm.

111. The applicator of claim 82, wherein the projection elements have differing heights.

112. The applicator of claim 82, wherein at least three consecutive projection elements of the row of consecutive projection elements define a part of a volume configured to contain the product to be applied.

113. The applicator of claim 81, wherein there are at least two projection members, said at least two projection members being oriented in substantially the same direction of gyration about a longitudinal axis of the base portion.

114. The applicator of claim 81, wherein the base portion has a cross-section chosen from elliptical and circular.

115. The applicator of claim 81, wherein the at least one projection member and the base portion are molded together as a single piece.

116. The applicator of claim 115, wherein the at least one projection member and the base portion are molded together using plastic.

117. The applicator of claim 81, wherein the base portion is substantially elongate and the at least one projection member extends along the length of the base portion.

118. The applicator of claim 81, wherein the projection member has a serrated edge opposite to where the projection member meets the base portion.

119. The applicator of claim 81, wherein the stem is produced from molding.

120. The applicator of claim 119, wherein the stem is produced by molding plastic.

121. The applicator of claim 81, wherein the stem is a non-twisted wire stem.

122. The applicator of claim 81, wherein a height of the at least one projection member ranges from approximately 0.5 mm to approximately 15 mm.

123. The applicator of claim 81, wherein a height of the at least one projection member ranges from approximately 7 mm to approximately 13 mm.

124. The applicator of claim 81, wherein the application element is removably connected to a distal end portion of the stem.

125. The applicator of claim 81, wherein a longitudinal axis of the base portion extends substantially parallel to a longitudinal axis of the stem.

126. The applicator of claim 81, wherein the base portion has a substantially uniform cross-section over at least a portion of its length.

127. The applicator of claim 81, wherein the application element includes a plurality of projection members.

128. The applicator of claim 81, wherein the application element includes two projection members disposed substantially diametrically opposite from one another.

129. The applicator of claim 128, wherein the projection members extend from the base portion in substantially opposite directions.

130. The applicator of claim 81, wherein a height of the projection member varies along a length of the base portion.

131. The applicator of claim 81, wherein the axis of the projection member extends substantially in a plane perpendicular to the longitudinal axis of the base portion.

132. An applicator system comprising:

the applicator of claim 81; and a container configured to contain the product.

133. The system of claim 132, further comprising:

a wiper configured to remove excess product from the projection member when the applicator is removed from the container.

134. The system of claim 133, wherein the wiper is deformable.

135. The system of claim 134, wherein the wiper is chosen from a block of foam and an elastomeric lip.

136. The system of claim 132, wherein the product is contained in the container and the product is a cosmetic product for the eyelashes.

137. The system of claim 136, wherein the product is mascara.

138. The system of claim 132, wherein the container includes an opening configured to permit passage of at least a part of the application element into the container, and wherein the system further comprises a cap at another end of the stem, the cap being configured to sealably close the opening.

139. A method for applying a product to eyelashes, comprising:

providing the applicator of claim 81;

loading a product on at least a part of the application element; and placing at least a part of the application element in contact with the eyelashes such that the product coats the eyelashes.

140. The method of claim 139, wherein the loading includes inserting the applicator into a container containing the product.

141. The method of claim 140, further comprising removing the applicator from the container and wiping excess product from the application element.

142. The method of claim 139, wherein the loading includes dispensing the product from the container onto the application element.

143. The method of claim 139, wherein the loading includes contacting the application element with a solid cake of product.

144. The method of claim 143 further comprising moistening the solid cake of product.

145. The method of claim 139, further comprising gripping the eyelashes with at least part of the application element.

146. The method of claim 139, wherein the product is mascara.

147. The method of claim 146, wherein the mascara includes fibers, and wherein the method further comprises orienting the fibers with the application element such that the fibers are substantially parallel to the eyelashes as the product is applied.

148. The method of claim 139, further comprising connecting a portion of the application element of the applicator to the stem of the applicator.

149. The method of claim 148, further comprising selecting an application element from a plurality of application elements and connecting the application element to the stem.

150. The method of claim 139, wherein the placing includes contacting the eyelashes first with product loaded on the base portion of the application element and then with the product loaded on the at least one projection member of the application element.

151. An applicator for applying a product to eyelashes, comprising:

a stem; and an application element disposed on an end of the stem, said application element including a base portion having a polygonal cross-section and a plurality of sides, and a plurality of projection members disposed on the base portion, at least two of said projection members extending away from the base portion substantially in continuation of different sides of the base portion, and said at least two projection members being oriented in the same direction of gyration about a longitudinal axis of the base portion.

152. An applicator of claim 151, wherein the projection members extend from the base portion in different facing directions from one another.

153. The applicator of claim 151, wherein at least one of the projection members includes a row of consecutive projection elements.

154. The applicator of claim 153, wherein the base portion is substantially elongate and the row of consecutive projection elements extends along the length of the base portion.

155. The applicator of claim 154, wherein the stem is produced by molding plastic.

156. The applicator of claim 153, wherein the row of consecutive projection elements includes consecutive projection elements alternately disposed at least partially on opposite sides of a geometric separation surface.

157. The applicator of claim 153, wherein the projection elements have a height ranging from approximately 0.5 mm to approximately 15 mm.

158. The applicator of claim 153, wherein the projection elements have a height ranging from approximately 7 mm to approximately 13 mm.

159. The applicator of claim 153, wherein the projection elements have differing heights.

160. The applicator of claim 153, wherein at least three consecutive teeth of the row of consecutive teeth define at least part of a volume configured to contain the product to be applied.

161. The applicator of claim 151, wherein the projection elements are chosen from teeth and bristles.

162. The applicator of claim 151, wherein the base portion has a cross-section chosen from triangular, square, pentagonal and hexagonal.

163. The applicator of claim 151, wherein the projection members and the base portion are molded together as a single piece.

164. The applicator of claim 163, wherein the projection members and the base portion are molded together using plastic.

165. The applicator of claim 151, wherein the base portion is substantially elongate and the projection members extend along the length of the base portion.

166. The applicator of claim 151, wherein the projection members have a serrated edge opposite to where the projection members meet the base portion.

167. The applicator of claim 151, wherein the stem is produced from molding.

168. The applicator of claim 151, wherein the stem is a non-twisted wire stem.

169. The applicator of claim 151, wherein a height of the projection member ranges from approximately 0.5 mm to approximately 15 mm.

170. The applicator of claim 151, wherein a height of the projection member ranges from approximately 7 mm to approximately 13 mm.

171. The applicator of claim 151, wherein the application element is removably connected to a distal end portion of the stem.

172. The applicator of claim 151, wherein the longitudinal axis of the base portion extends substantially parallel to a longitudinal axis of the stem.

173. The applicator of claim 151, wherein each projection member and an adjacent side of the base portion, other than the side from which the projection member extends substantially in continuation, define an open volume configured to contain product to be applied.

174. The applicator of claim 151, wherein the base portion has a substantially uniform cross-section over at least a portion of its length.

175. The applicator of claim 151, wherein the cross-section of the base portion is chosen from a regular polygon and an irregular polygon.

176. The applicator of claim 151, wherein the cross-section of the base portion is a regular polygon.

177. The applicator of claim 151, wherein at least one of the sides of the polygon is non-planar.

178. An applicator system comprising:

the applicator of claim 151; and a container configured to contain the product.

179. The system of claim 178, further comprising:

a wiper configured to remove excess product from the projection members when the applicator is removed from the container.

180. The system of claim 179, wherein the wiper is deformable.

181. The system of claim 180, wherein the wiper is chosen from a block of foam and an elastomeric lip.

182. The system of claim 178, wherein the product is contained in the container and the product is a cosmetic product for the eyelashes.

183. The system of claim 182, wherein the product is mascara.

184. The system of claim 178, wherein the container includes an opening configured to permit passage of at least a part of the application element into the container, and wherein the system further comprises a cap at another end of the stem, the cap being configured to sealably close the opening.

185. A method for applying a product to eyelashes, comprising:

providing the applicator of claim 151;

loading a product on at least a part of the application element; and placing at least a part of the application element in contact with the eyelashes such that the product coats the eyelashes.

186. The method of claim 185, wherein the loading includes inserting the applicator into a container containing the product.

187. The method of claim 186, further comprising removing the applicator from the container and wiping excess product from the application element.

188. The method of claim 185, wherein the loading includes dispensing the product from the container onto the application element.

189. The method of claim 185, wherein the loading includes contacting the application element with a solid cake of product.

190. The method of claim 189, further comprising moistening the solid cake of product.

191. The method of claim 185, further comprising gripping the eyelashes with at least part of the application element.

192. The method of claim 185, wherein the product is mascara.

193. The method of claim 192, wherein the mascara includes fibers, and wherein the method further comprises orienting the fibers with the application element such that the fibers are substantially parallel to the eyelashes as the product is applied.

194. The method of claim 185, further comprising connecting a portion of the application element of the applicator to the stem of the applicator.

195. The method of claim 194, further comprising selecting an application element from a plurality of application elements and connecting the application element to the stem.

196. The method of claim 185, wherein the placing includes contacting the eyelashes first with product loaded on the base portion of the application element and then with the product loaded on one of the projection members of the application element.

197. The applicator of claim 151, wherein the projection members extend from the application element at origination locations spaced from a longitudinal axis of the base portion.

198. The applicator of claim 151, wherein the application element lacks a twisted wire.

199. The applicator of claim 151, wherein the base portion includes solid sides.

200. The applicator of claim 151, wherein the base portion is a single piece, integral structure.

201. The applicator of claim 200, wherein the base portion is a molded structure.

* * * * *

UNITED STATES PATENT AND TRADEMARK OFFICE

CERTIFICATE OF CORRECTION

PATENT NO. : 6,343,607 B1
DATED : February 5, 2002
INVENTOR(S) : Jean-Louis H. Gueret It is certified that error appears in the above-identified patent and that said Letters Patent is hereby corrected as shown below:

Column 23,
Line 34, replace "where n" with -- wherein --.

Column 24,
Line 34, replace "teeth an" with -- teeth and --.

Signed and Sealed this

Twenty-third Day of April, 2002

*Attest:*

*Attesting Officer*

JAMES E. ROGAN
*Director of the United States Patent and Trademark Office*